US007523571B2

(12) United States Patent
Mills et al.

(10) Patent No.: US 7,523,571 B2
(45) Date of Patent: Apr. 28, 2009

(54) MACHINE WITH ADAPTER FRAME FOR WEIGHT STABILIZATION

(75) Inventors: Matt Mills, Pella, IA (US); Ted Sanders, Chariton, IA (US); Brad Pinkerton, New Sharon, IA (US); Arlyn Klyn, New Sharon, IA (US)

(73) Assignee: Vermeer Manufacturing Company, Pella, IA (US)

( * ) Notice: Subject to any disclaimer, the term of this patent is extended or adjusted under 35 U.S.C. 154(b) by 504 days.

(21) Appl. No.: 11/236,430

(22) Filed: Sep. 26, 2005

(65) Prior Publication Data

US 2007/0068051 A1 Mar. 29, 2007

(51) Int. Cl.
*B62D 33/10* (2006.01)

(52) U.S. Cl. ..... 37/403; 180/89.13

(58) Field of Classification Search ..... 37/347, 37/355, 361, 362, 189, 190, 462–465, 403; 180/89.13, 291, 298
See application file for complete search history.

(56) References Cited

U.S. PATENT DOCUMENTS

| | | | | |
|---|---|---|---|---|
| 3,185,316 | A * | 5/1965 | Bennett, Sr. | 212/196 |
| 3,567,049 | A * | 3/1971 | Guinot | 414/694 |
| 3,734,223 | A | 5/1973 | Anderson | |
| 4,230,199 | A * | 10/1980 | Stedman | 180/9.1 |
| 6,408,971 | B1 * | 6/2002 | Grant | 180/89.13 |

FOREIGN PATENT DOCUMENTS

EP 1 152 092 A1 11/2001

* cited by examiner

*Primary Examiner*—Gary S Hartmann
(74) *Attorney, Agent, or Firm*—Merchant & Gould P.C.

(57) ABSTRACT

A mobile trencher machine having an upper assembly, a ground drive assembly, and an adapter frame positioned between and coupled to each of the upper assembly and the ground drive assembly. The ground drive assembly being positionable in one of a number of mounting positions relative to the upper assembly, including a forward position, a rearward position, and a central position.

10 Claims, 25 Drawing Sheets

MACHINE WITH ADAPTER FRAME FOR WEIGHT STABILIZATION

TECHNICAL FIELD

This disclosure generally relates to the construction of a mobile machine used for underground installation of utilities. More particularly, this disclosure relates to the overall arrangement of such machines for balancing the weight of tool attachments.

BACKGROUND

A variety of excavation tools have been developed for installing underground utilities. Such excavation tools can include chain trenchers, backhoes, and vibratory plows, for example. Each of these tools has distinct advantages, and contractors often utilize more than one type of tool for a particular excavation project. Accordingly, power units or tractors have been developed to operably carry a variety of excavation tools. One such power unit is commonly referred to as a rubber tire trencher.

Referring now to FIG. 1, one example of a rubber tire trencher or tractor 10 is illustrated. The tractor 10 typically includes an engine 12 supported by a main frame 14. In the illustrated embodiment, an operator station 16 and a roll over protection bar 18 are positioned near the rear of the tractor 10. The tractor 10 further includes a front adapter 20 and a rear adapter 22 both configured to provide mounts for excavation tools or implement attachments. A front axle 24 and a rear axle 26, each with rubber tires for ground engagement, are coupled to the main frame 14 of the tractor 10.

Still referring to FIG. 1, a chain trencher 28 is one example of an excavation tool that can be attached to the tractor 10 for use in installing underground utilities. The chain trencher 28 includes a continuous digging chain 30 that is powered around a digging boom 32. The continuous digging chain 30 of the chain trencher 28 is used to form a trench in the soil by pulling material towards the surface. An auger (not shown) moves the soil cuttings to the side of the trench. Utilities are installed into the trench, and the soil cuttings are then pushed back into the trench by a backfill blade 38 (FIG. 2) to bury the installed utilities.

FIG. 1 illustrates the tractor 10 in a first exemplary configuration for installing underground utilities. The first configuration includes the chain trencher 28 mounted to the rear adapter 22 of the tractor 10. During operation, the continuous digging chain 30 rotates about the digging boom 32 in the direction shown. The operator is seated at the operator station 16, and is able to observe the chain trencher 28 while controlling the speed and direction of travel of the tractor 10.

The chain trencher 28 is shown in a lowered, operating position in FIG. 1 for formation of a trench. FIG. 2 illustrates the chain trencher 28 in a raised transport position for transportation of the chain trencher. As can be understood, the weight of the chain trencher 28 is significant. Accordingly, a weight kit 36 is often mounted at the front of the tractor 10 to counter balance of the weight of the chain trencher 28 at the rear when the trencher 28 is in the raised transport position, as shown in FIG. 2.

Referring now to FIG. 3, a backhoe 40 is another example of an excavation tool the can be used to install underground utilities. The backhoe 40 includes a bucket 42 for digging a trench in the soil. Typically, the backhoe 40 includes a separate operator station 42. In use, the operator moves the tractor 10 to the desired location. The operator then moves from the tractor operator station 16 to the backhoe operator station 42 to perform the excavation. When excavating with the backhoe 40, the tractor 10 is in a stationary position. The backhoe 40 is often used to form larger excavations so that personnel can work within the formed trench to make necessary utility connections or repairs, for example.

FIG. 3 illustrates the tractor 10 a second exemplary configuration for installing underground utilities. In particular, the second configuration includes the same set-up between the tractor 10 and chain trencher 28, as shown in FIG. 1, but now also includes the backhoe 40 mounted to the front adapter 20 of the tractor 10. In the second configuration, the backhoe 40 is mounted at the front of the tractor 10 in place of the weight kit 36. Accordingly, the backhoe 40 is used to counter balance of the weight of the chain trencher 28 at the rear when the trencher 28 is in the raised position.

Referring now to FIG. 4, a vibratory plow 44 is yet another example of an excavation tool that can be used for installing underground utilities. The illustrated plow 44 includes a vibrating blade 46. During use, the blade 46 is forced into the soil to a depth equal to the desired depth of the underground utility. As the blade 46 is pulled through the ground, a chute (not shown) follows the blade 46 and installs the utility at the desired depth.

FIG. 4 illustrates the tractor 10 in a third exemplary configuration for installing underground utilities. In the third configuration, the tractor 10 includes the same set-up between the tractor 10 and backhoe 40, as shown in FIG. 3, but now also includes the plow 44 mounted to the rear adapter 22 instead of the chain trencher 28. The plow 44 weighs less than the chain trencher 28; accordingly, the weight balance of this configuration is different than that of the others.

The weight balance of the tractor or machine 10 is different in each of the illustrated configurations. Each of the attachments (e.g., the chain trencher 28, the backhoe 40, and the plow 44) introduces a different weight stabilization relationship that requires a different balancing solution. An improved method and arrangement for properly balancing a tractor or power unit in various configurations is needed.

SUMMARY

One aspect of the present disclosure relates to an excavation machine having an upper assembly, a ground drive assembly, and an adapter frame located between, and coupled to each of, the upper assembly and the ground drive assembly. The upper assembly includes front and rear mounting arrangements for attachment of various excavation implements. The adapter frame includes a number of bolt hole sets for interconnecting the ground drive assembly in one of a number of positions relative to the upper assembly. The number of positions includes a forward position, a central position, and a rearward position. The ground drive assembly and the upper assembly are selectively coupled relative to one another in the desired position that best accommodates a particular weight configuration of the machine. The weight configuration of the machine is determined by the type and arrangement of excavation implements selectively attached to the upper assembly.

DETAILED DESCRIPTION

Reference will now be made to various features of the present invention illustrated in the accompanying drawings. Wherever possible, the same reference numbers will be used throughout the drawings to refer to the same or like parts.

Figure 5:
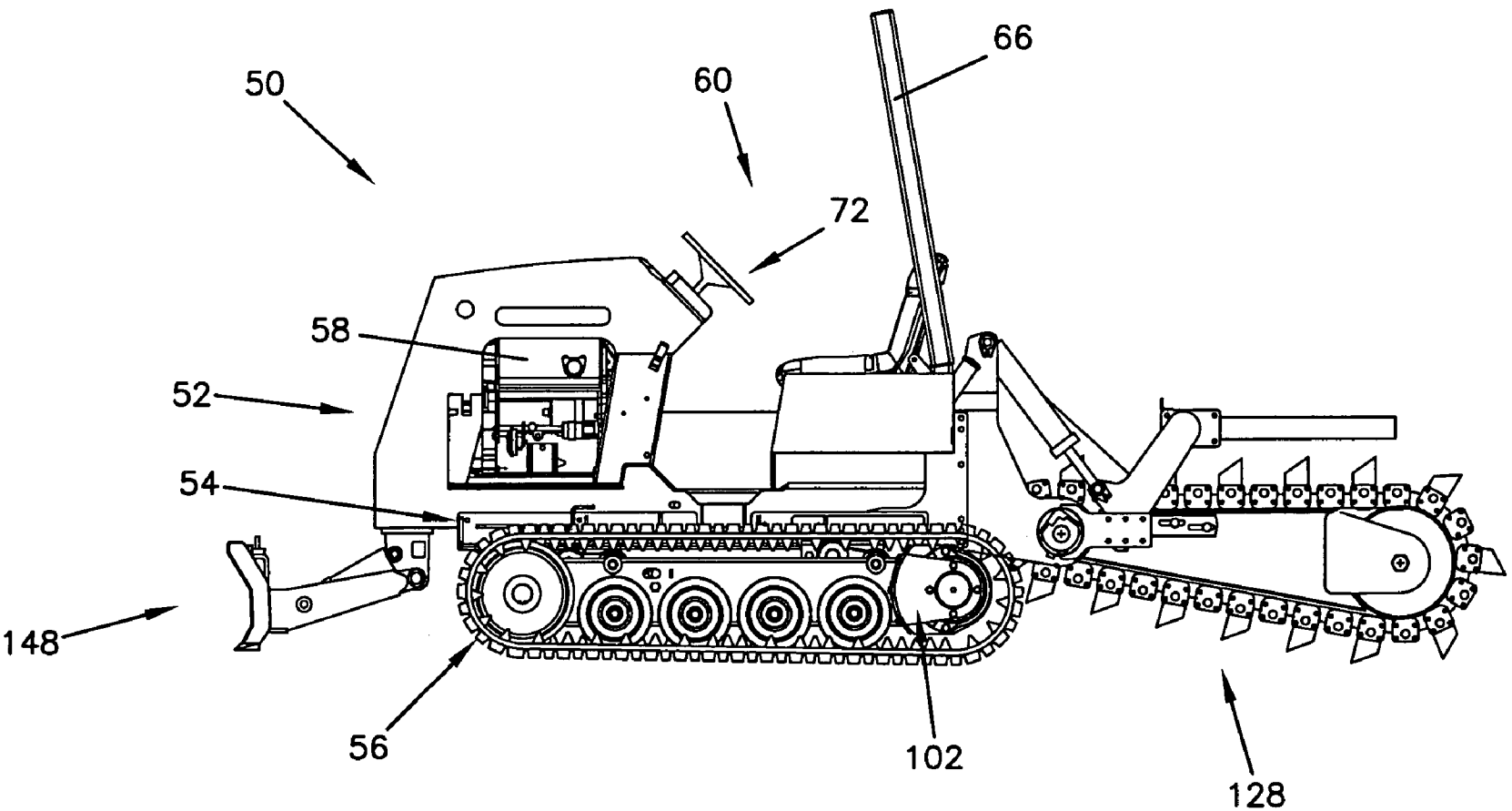
FIG. 5 is a side elevation view of one embodiment of a trencher machine, in accordance with the principles of the present disclosure.
Figure 6:
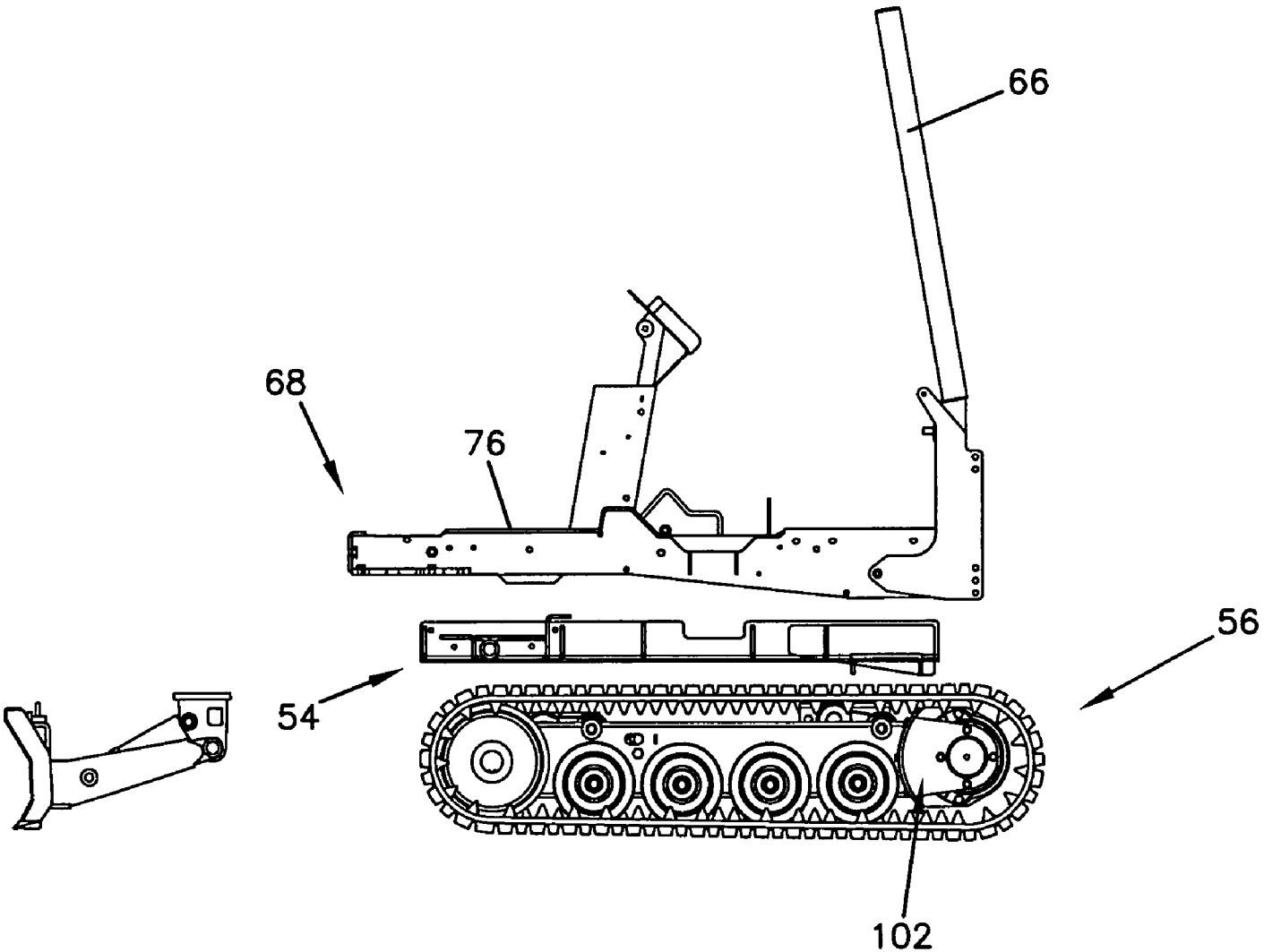
FIG. 6 is an exploded side view of the trencher machine of FIG. 5, showing a main frame assembly, an adapter frame, and a ground drive assembly of the machine, the ground drive assembly is mounted in a rearward position relative to the main frame assembly.

Referring now to FIGS. 5 and 6, one embodiment of tractor or mobile trencher machine 50, in accordance to the principles disclosed, is illustrated. The machine 50 generally includes an upper assembly 52, an adapter frame 54, and an undercarriage or ground drive assembly 56. The adapter frame 54 is coupled between, and to each of, the upper assembly 52 and the ground drive assembly 56. As will be described in greater detail hereinafter, the adapter frame 54 permits selective positioning or placement of the ground drive assembly 56 in relation to the upper assembly 52.

The upper assembly 52 of the mobile machine 50 includes a main engine frame assembly 68 (FIGS. 6 and 7), an engine 58 (FIG. 5) to power operation of the machine, and an operator station 60. The engine 58 of the machine 50 is mounted to a mounting surface 76 (FIG. 7) of the main engine frame assembly 68. In some embodiments, the main engine frame assembly 68 of the machine 50 can include a frame having the same configuration as the main frame 14 of the prior art tractor 10 shown in FIGS. 1-4.

The operator station 60 of the embodiment shown in FIG. 5 includes a steering wheel 72 and other controls for operating the machine. In some applications, the controls at the operator station 60 are also used for operating the attached excavation implements. The upper assembly 52 (FIG. 5) also includes a roll over protection bar 66 coupled to the main frame assembly 68.

Figure 7:
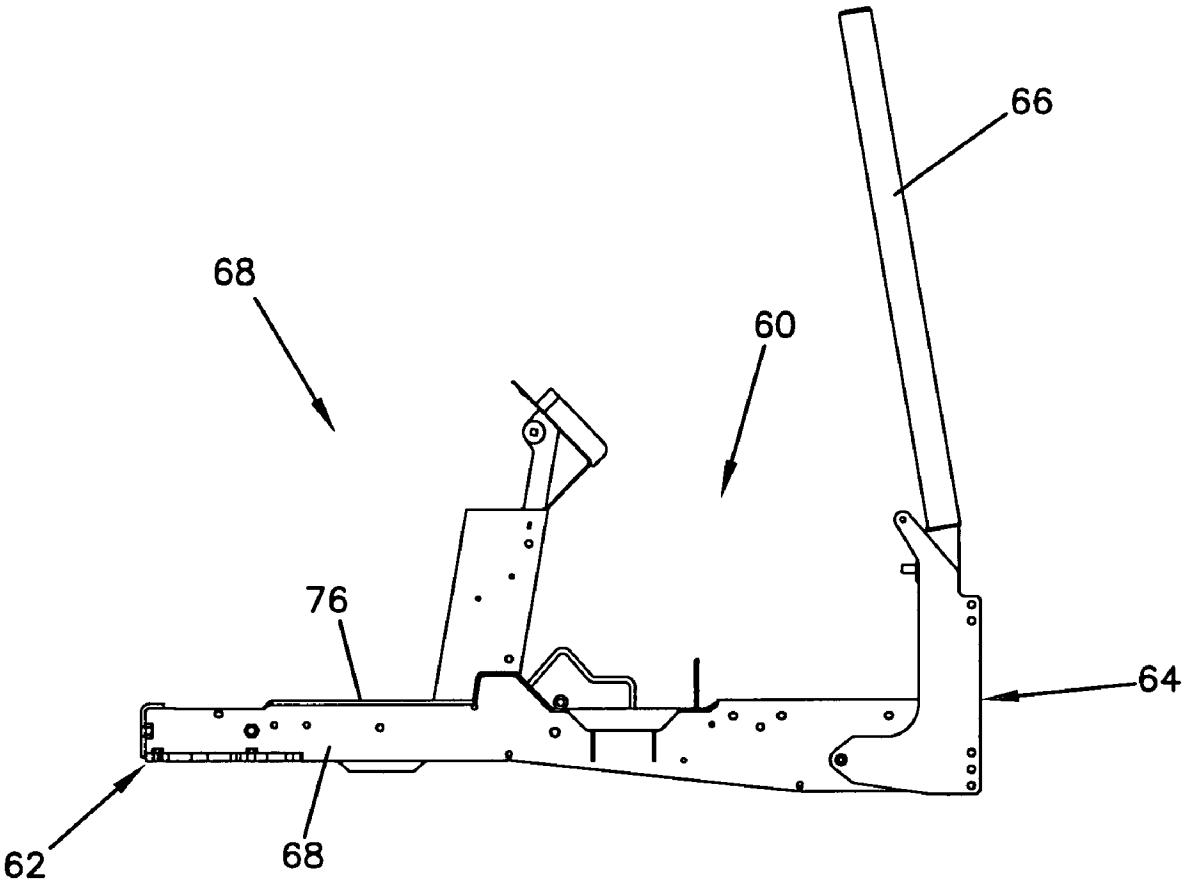
FIG. 7 is a side elevation view of the main frame assembly of FIG. 6.
Figure 8:
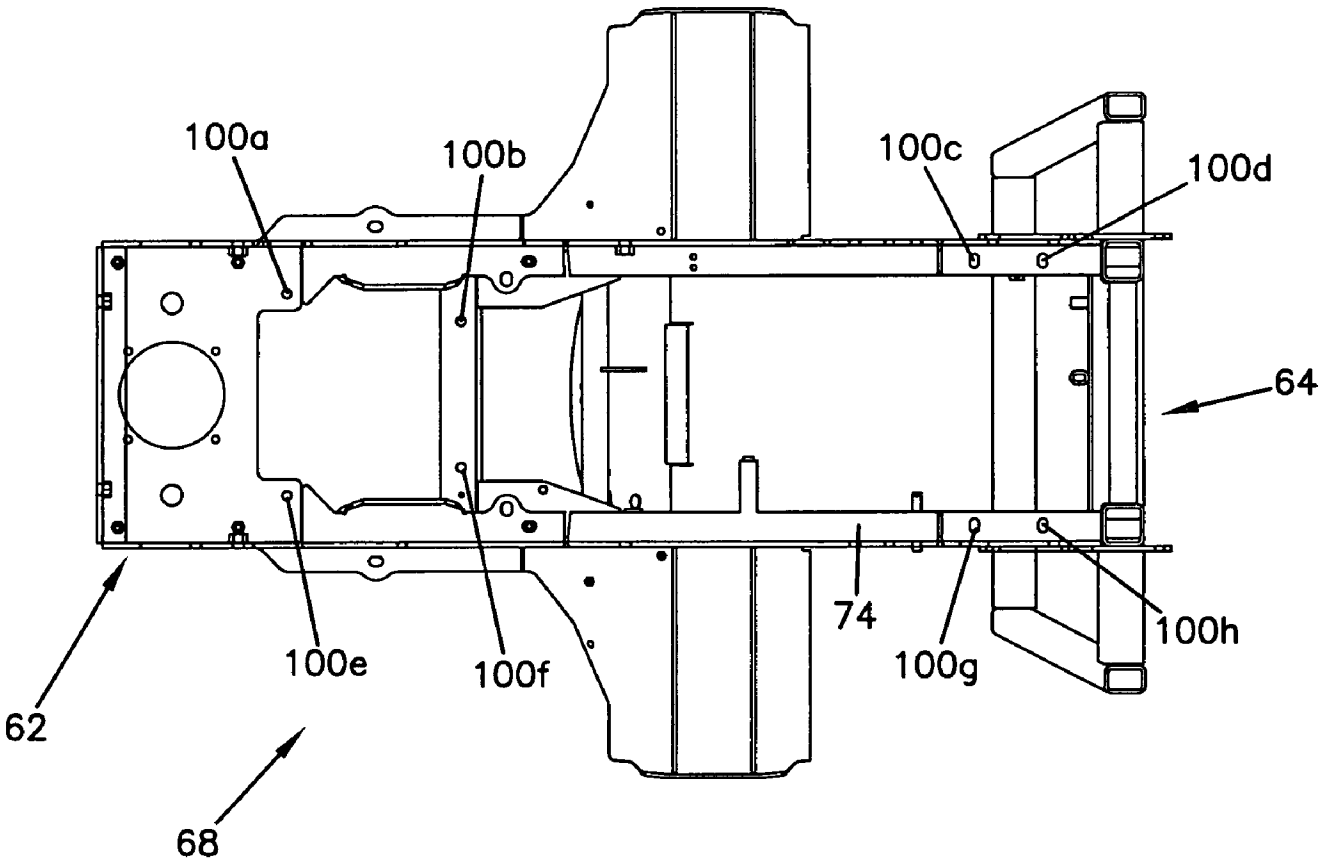
FIG. 8 is a bottom plan view of the main frame assembly of FIG. 7.

Referring now to FIGS. 7 and 8, the main frame assembly 68 of the upper assembly 52 includes a front mounting arrangement 62 and a rear mounting arrangement 64 for attaching excavation implements or tools. The excavation implements can include, for example, a backhoe 140 (FIG. 13), a backfill blade 148 (FIG. 5), a chain trencher 128 (FIG. 5), and a vibratory plow 44 (FIG. 4), for example. Each of the excavation implements is similar to the implements previously described with respect to FIGS. 1-4. Other types of excavation implements or tools can also be used with the present excavation machine 50, in accordance with the principles disclosed.

Referring to FIG. 8, the main frame assembly 68 of the upper assembly 52 has a bottom side 74. The bottom side 74 includes an arrangement or pattern of mounting holes 100*a-h*. The pattern of mounting holes 100*a-h* is configured and arranged to align with mounting structure of a desired ground drive assembly. The ground drive assembly can be any one of a number of different types of ground drive assemblies.

Figure 1:
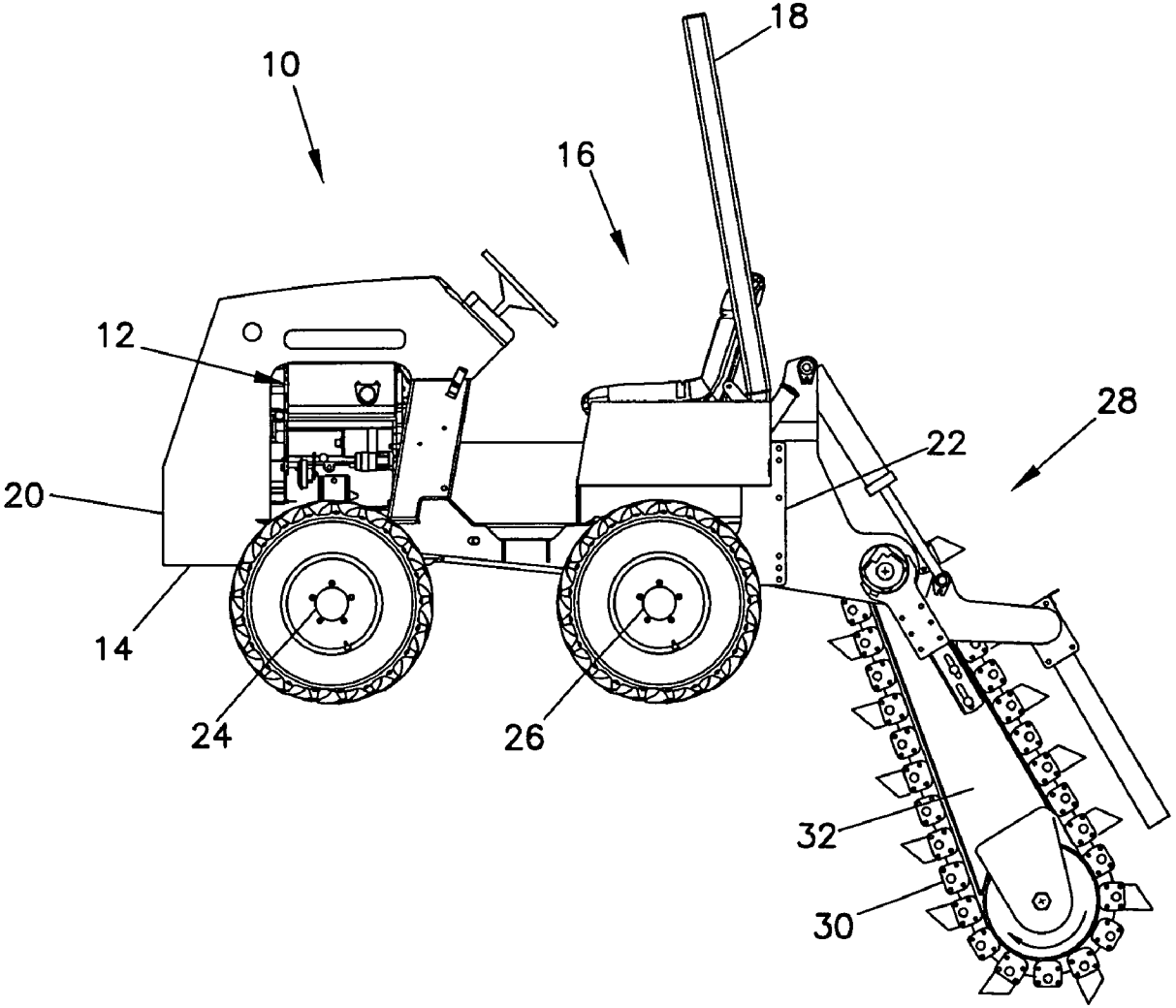
FIG. 1 (PRIOR ART)
FIG. 1 is a side elevation view of a prior art rubber tire trencher, shown with a chain trencher mounted at the rear of the trencher.
Figure 2:
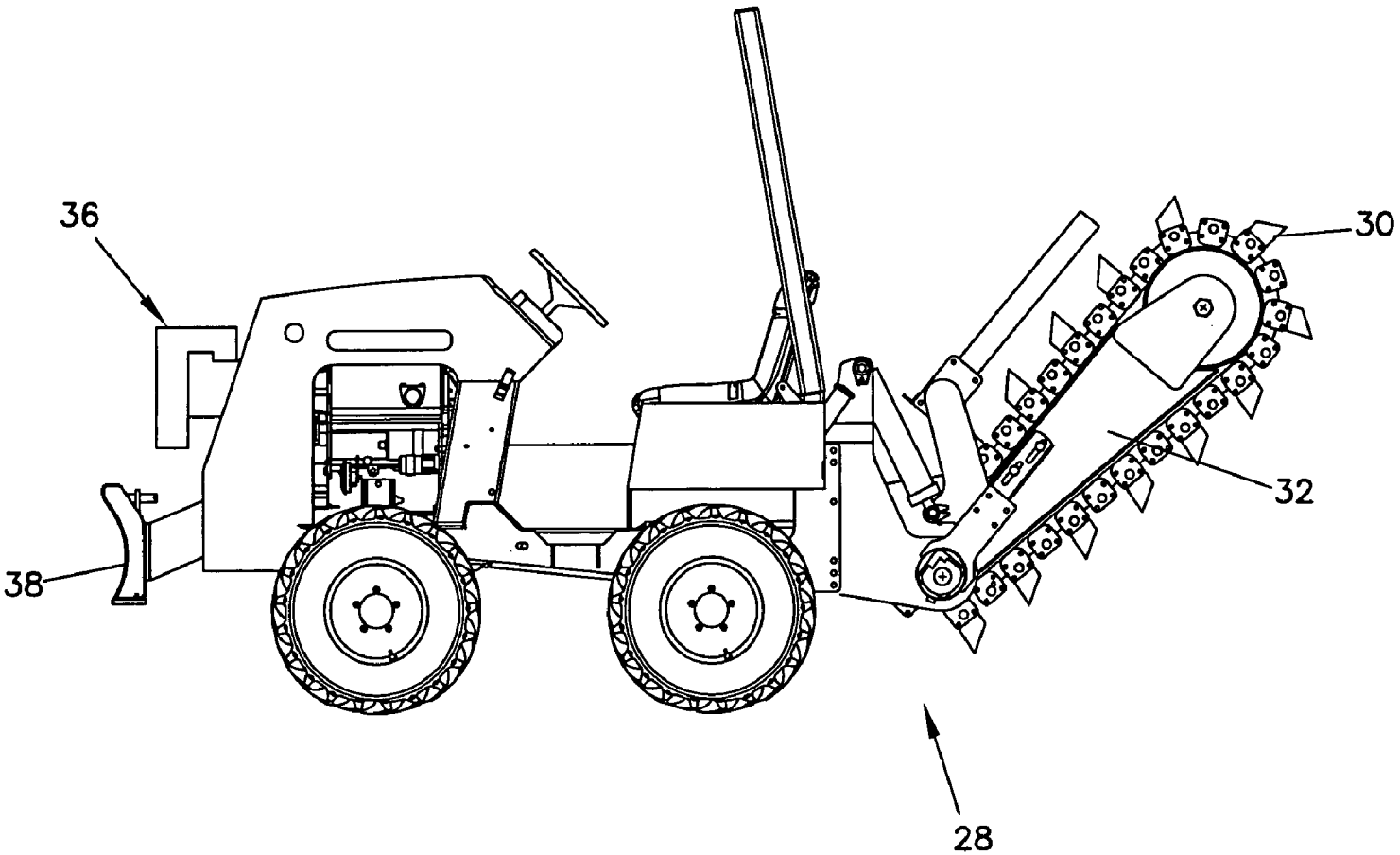
FIG. 2 (PRIOR ART)
FIG. 2 is a side elevation view of the prior art rubber tire trencher of FIG. 1, shown with a weight kit mounted at the front of the trencher.
Figure 3:
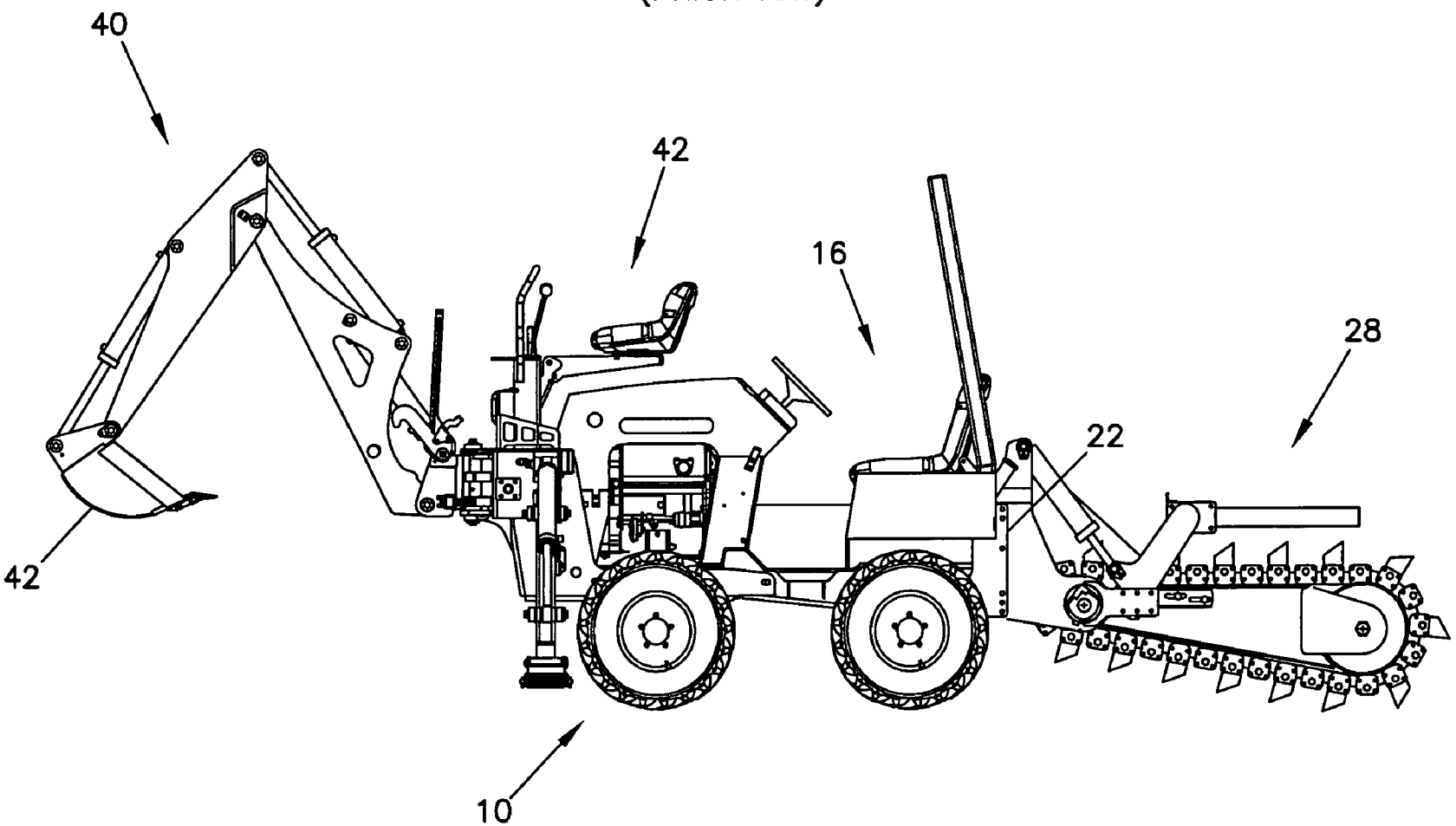
FIG. 3 (PRIOR ART)
FIG. 3 is a side elevation view of the prior art rubber tire trencher of FIG. 2, shown with a backhoe mounted at the front of the trencher.
Figure 4:
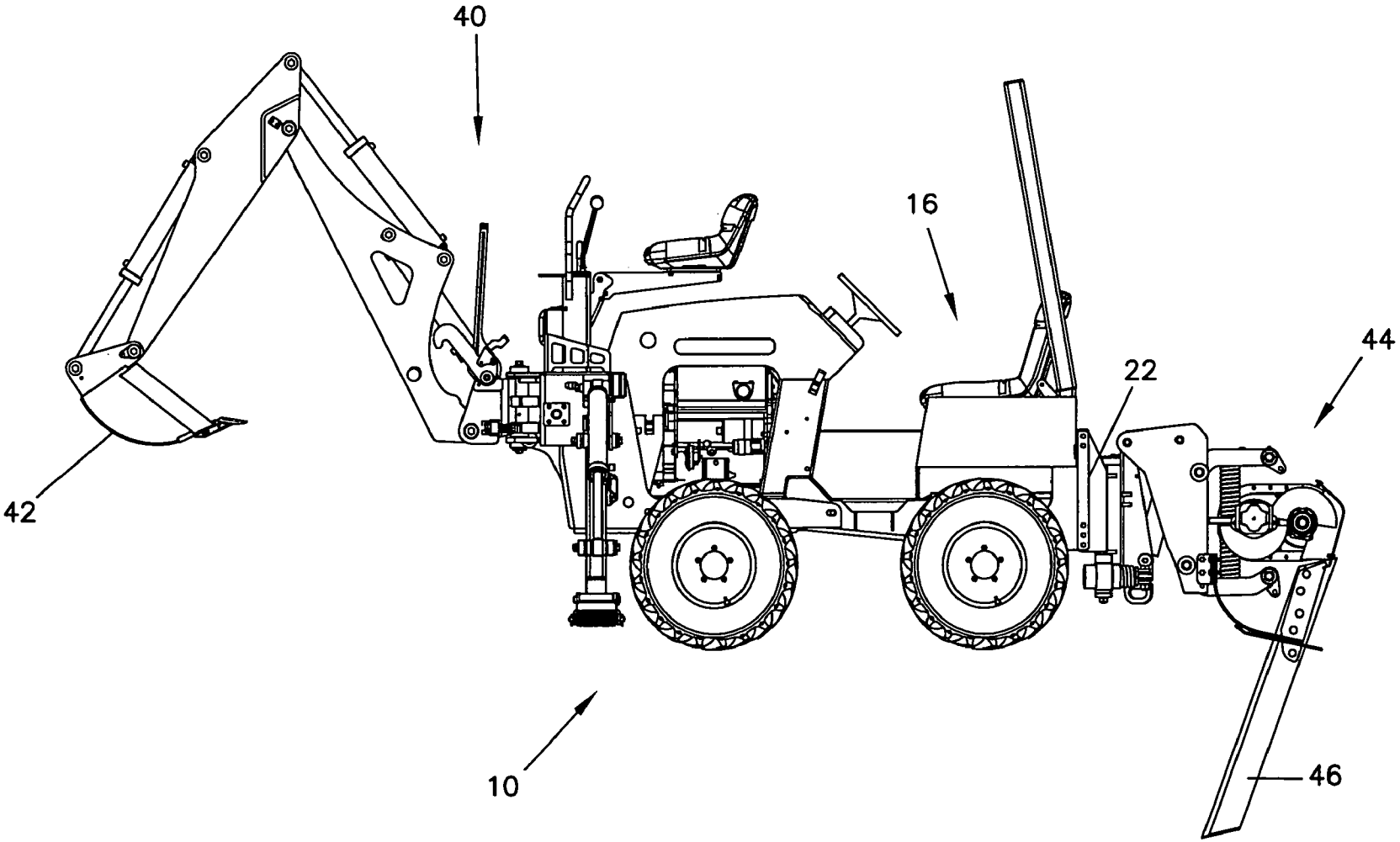
FIG. 4 (PRIOR ART)
FIG. 4 is a side elevation view of the prior art rubber tire trencher of FIG. 3, shown with a vibratory plow mounted at the rear of the trencher.

For instance, in the illustrated embodiment, the pattern of mounting holes 100*a-h* defined by the main frame assembly 68 of the upper assembly 52 is arranged to couple directly to the ground drive assembly of the rubber tire tractor 10 of FIG. 1 (i.e., the undercarriage having front and rear axles 24, 26). The pattern of mounting holes 100*a-h* is also arranged to couple to the adapter frame 54 and the ground drive assembly 56 of the presently disclosed machine 50. That is, the upper assembly 52 is adaptable for use in both the assembly and manufacture of a prior art tractor 10 (e.g., FIG. 1) and the presently disclosed mobile machine 50.

Figure 9:
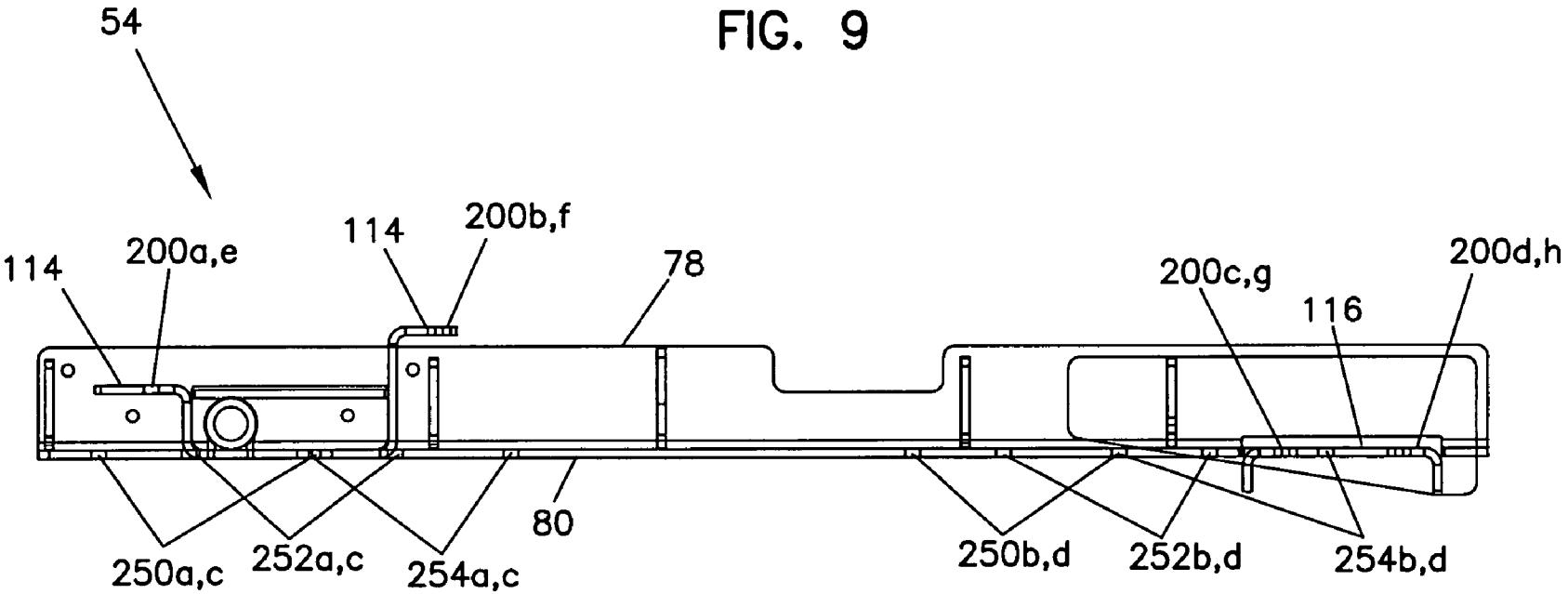
FIG. 9 is a side elevation view of the adapter frame of FIG. 6.

Referring now to FIG. 9, the adapter frame 54 of the present machine 50 is illustrated. The adapter frame 54 mounts between the upper assembly 52 and the ground drive assembly 56 of the machine 50 (as illustrated in FIG. 6). In particular, the adapter frame 52 includes a top side 78 adapted to couple to the bottom side 74 of the upper assembly 52 of the machine 50, and a bottom side 80 adapted to couple to a desired ground drive assembly, such as the ground drive assembly 56 shown in FIGS. 5 and 6.

Figure 10:
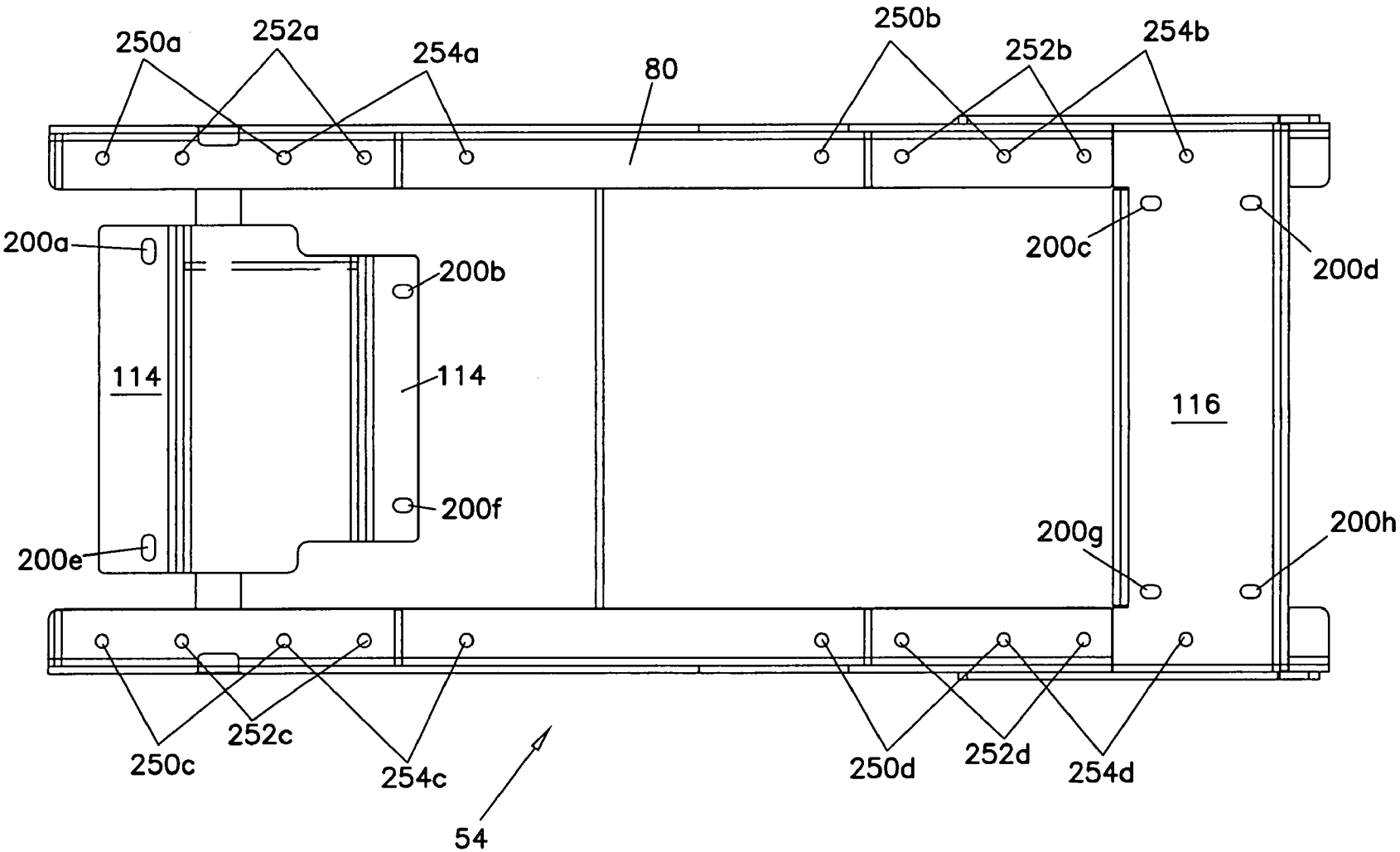
FIG. 10 is a bottom plan view of the adapter frame of FIG. 9.

Referring to FIG. 10, the bottom side 80 of the adapter frame 54 includes an arrangement or pattern of bolt holes or mounting holes 200*a-h*. The pattern of mounting holes of the adapter frame 54 corresponds to the pattern of mounting holes 100*a-h* of the main frame assembly 68. In the illustrated embodiment, the pattern of mounting holes 200*a-h* of the adapter frame 54 are formed in bracket flanges and surfaces 114, 116. The mounting holes 200*a-h* and flanges and surfaces 114, 116 are arranged to align with the pattern of mounting holes 100*a-h* and the structure of the main frame assembly 68. The adapter frame 54 is coupled to the main frame assembly 52 of the machine 50 by utilizing bolts (not shown) that pass through the mating holes 100*a-h*, 200*a-h*. In this embodiment, the mating holes 100*a-h*, 200*a-h* provide a vertical mounting arrangement. That is, the mounting structure (e.g., the bottom side 74 of the main frame assembly 68 and the surfaces 114, 116 of the adapter frame 54) defining the mating holes 100*a-h*, 200*a-h* is generally horizontal such that the bolts are received in a generally vertical orientation, relative to ground.

Still referring to FIG. 10, the adapter frame 54 also includes a first set of holes 250*a-d*, a second set of holes 252*a-d*, and a third set of holes 254*a-d*. Each of the sets, e.g., 250*a-d*, includes a four groupings of holes 250*a*, 250*b*, 250*c*, 250*d*; each grouping including a pair of holes for a total of eight holes in the set 250*a-d*. The sets of grouped bolt holes 250*a-d*, 252*a-d*, 254*a-d* is configured for mounting to the ground drive assembly 56.

Figure 11:
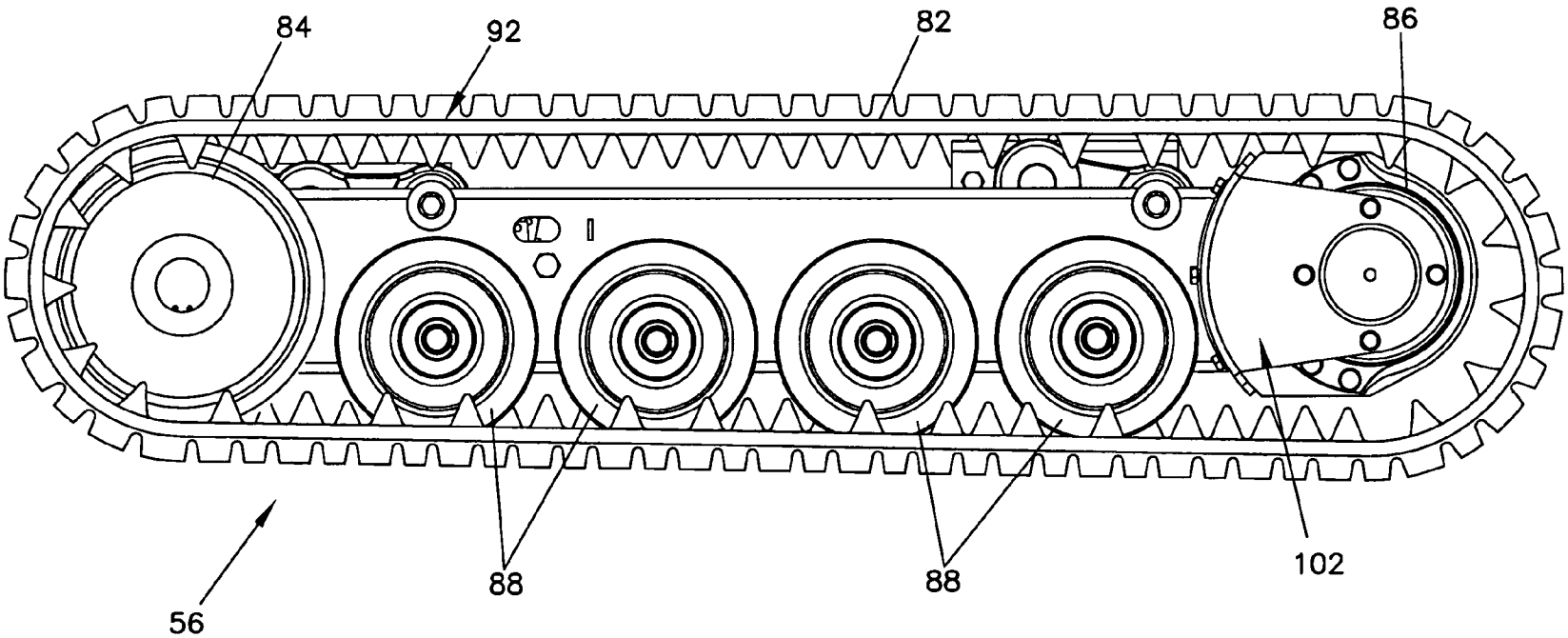
FIG. 11 is a side elevation view of the ground drive assembly of FIG. 6.
Figure 12:
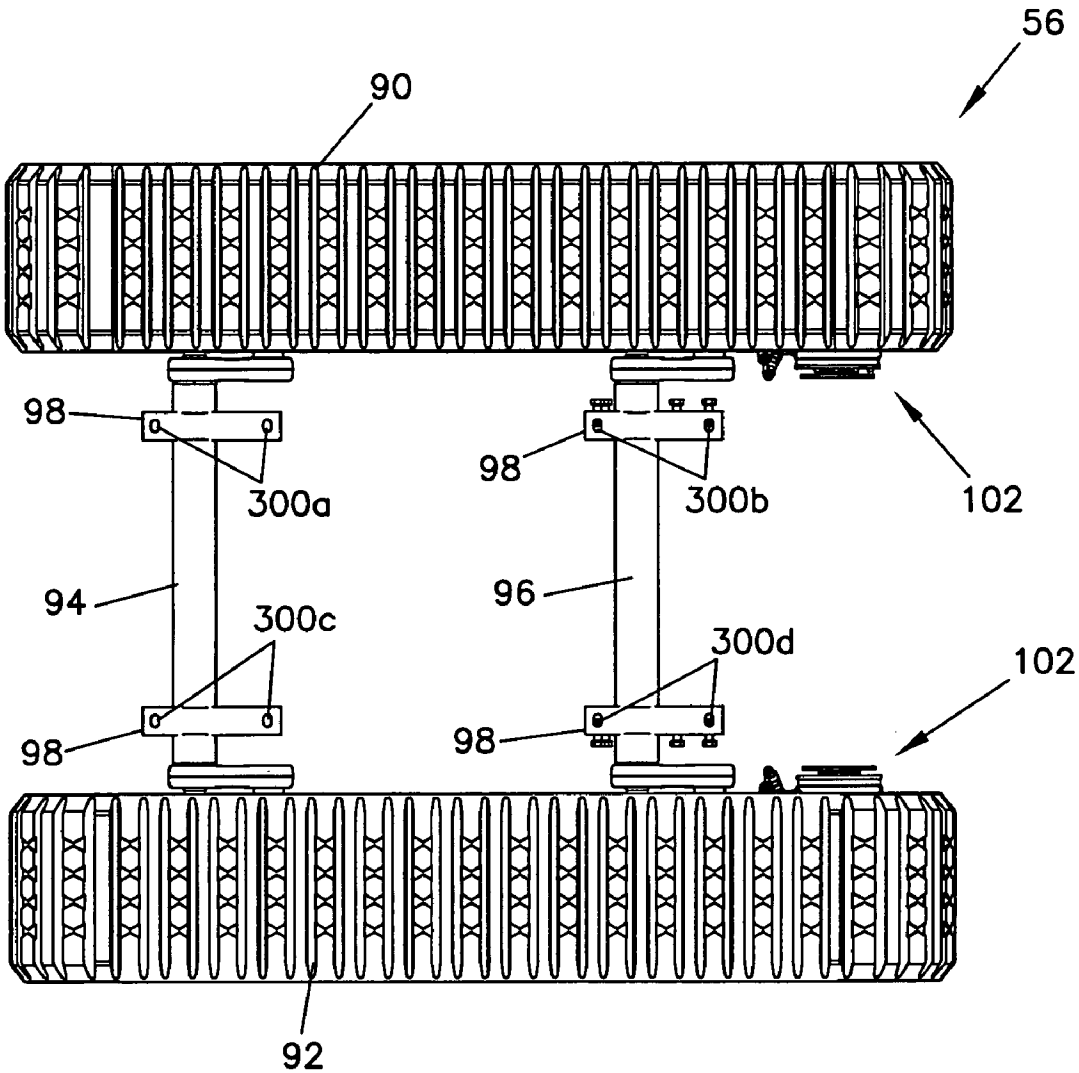
FIG. 12 is a top plan view of the ground drive assembly of FIG. 11.

Referring back to FIGS. 5 and 6, the ground drive assembly 56 of the machine 50 includes a drive arrangement 102 to provide travel of the machine and transport of the excavation implements. In one embodiment, the drive arrangement 102 includes right and left drive tracks 90, 92 (FIG. 12). Each of the right and left drive tracks 90, 92 includes a continuous track 82 (FIG. 11) wrapped around an idler roller 84 and a drive roller 86. Support rollers 88 are located between the idler roller 84 and the drive roller 86. Referring to FIG. 12, the right and left tracks 90, 92 of the ground drive assembly 56 are spaced apart by cross beams 94, 96.

Figure 23:
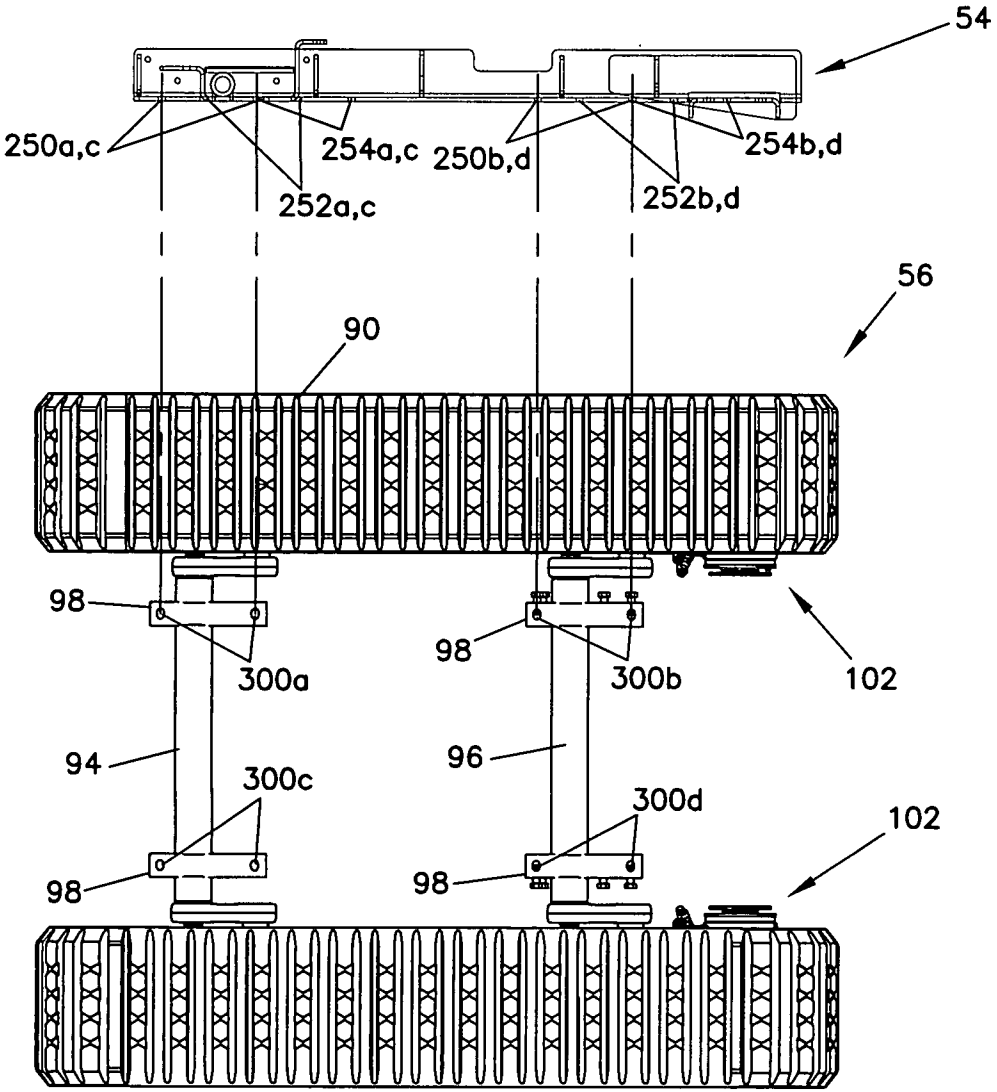
FIG. 23 illustrates the adapter frame of FIG. 9 and the ground drive assembly of FIG. 12, the ground drive assembly being located in a forward position relative to the adapter frame.
Figure 24:
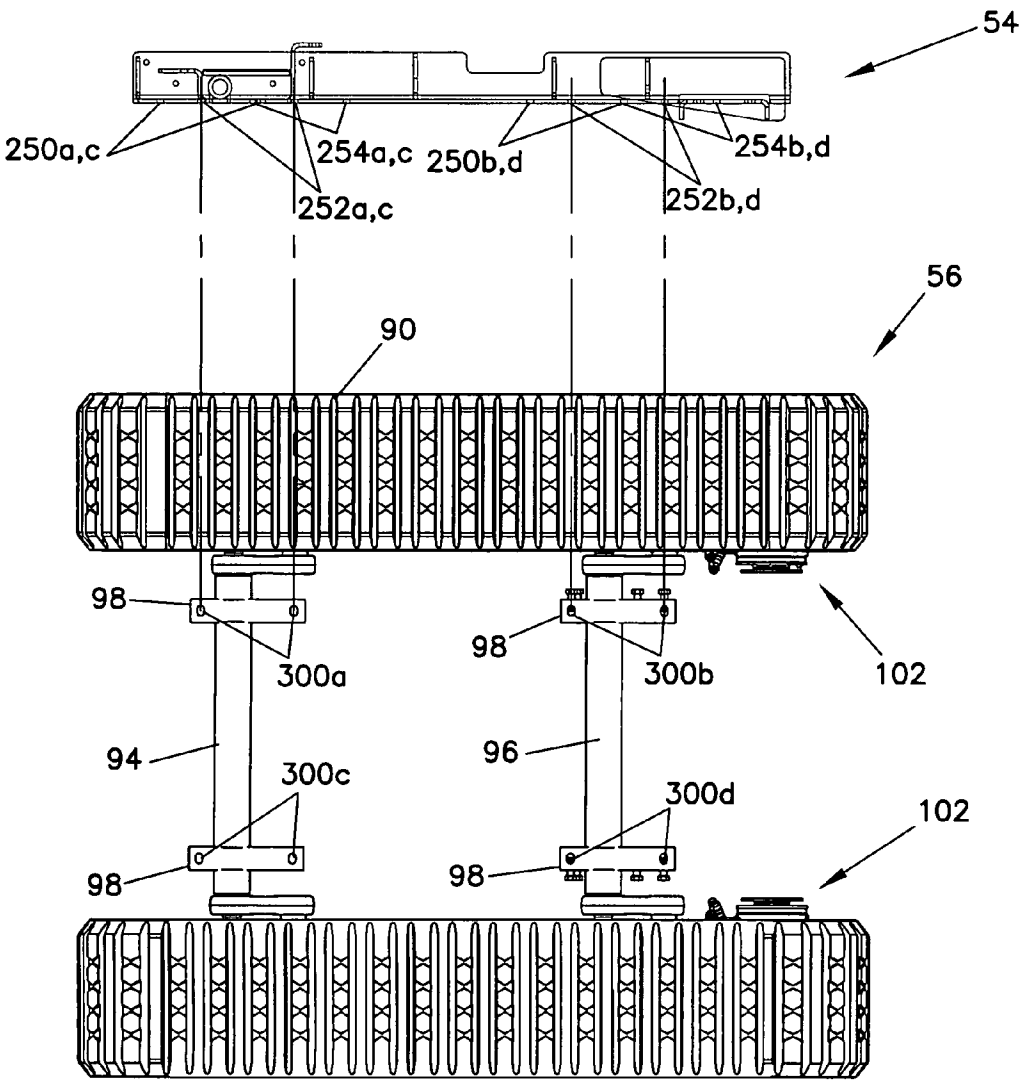
FIG. 24 illustrates the adapter frame of FIG. 9 and the ground drive assembly of FIG. 12, the ground drive assembly being located in a central position relative to the adapter frame.
Figure 25:
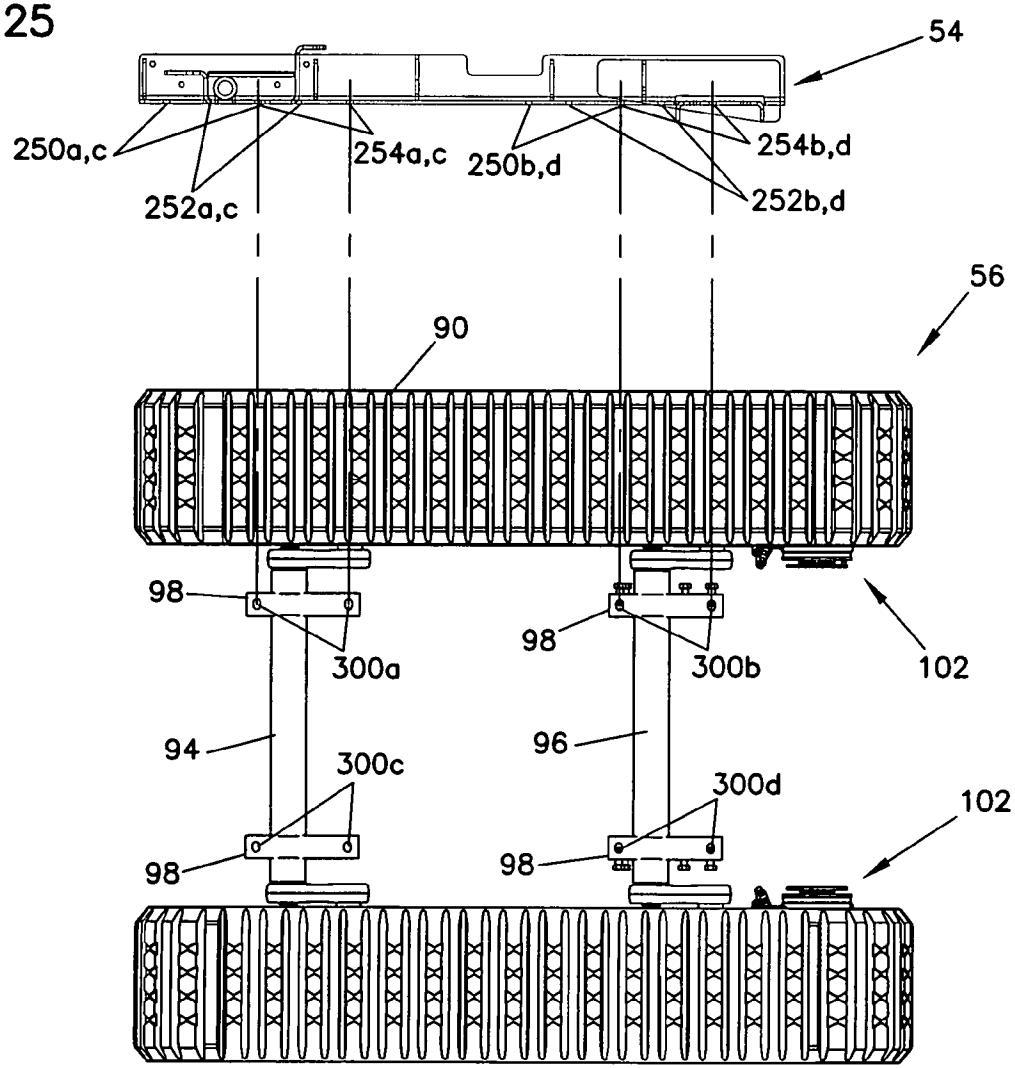
FIG. 25 illustrates the adapter frame of FIG. 9 and the ground drive assembly of FIG. 12, the ground drive assembly being located in a rearward position relative to the adapter frame.

As shown in FIG. 12, the ground drive assembly 56 of the machine 50 includes an arrangement or pattern of grouped bolt holes or mounting holes 300*a-d*. In the illustrated embodiment, the grouped bolt holes include bolt hole pairs. The pairs of bolt holes 300*a-d* are formed in flanges 98 mounted to the cross beams 94, 96. The pairs of bolt holes 300*a-d* are spaced apart and located to align with any one of the three sets of holes 250, 252 or 254 of the adapter frame 54. Accordingly, the ground drive assembly 56 can be attached to the adapter frame 54 in any one of three positions, including a forward position (FIG. 23), a centered position (FIG. 24), and a rearward position (FIG. 25).

Figure 17:
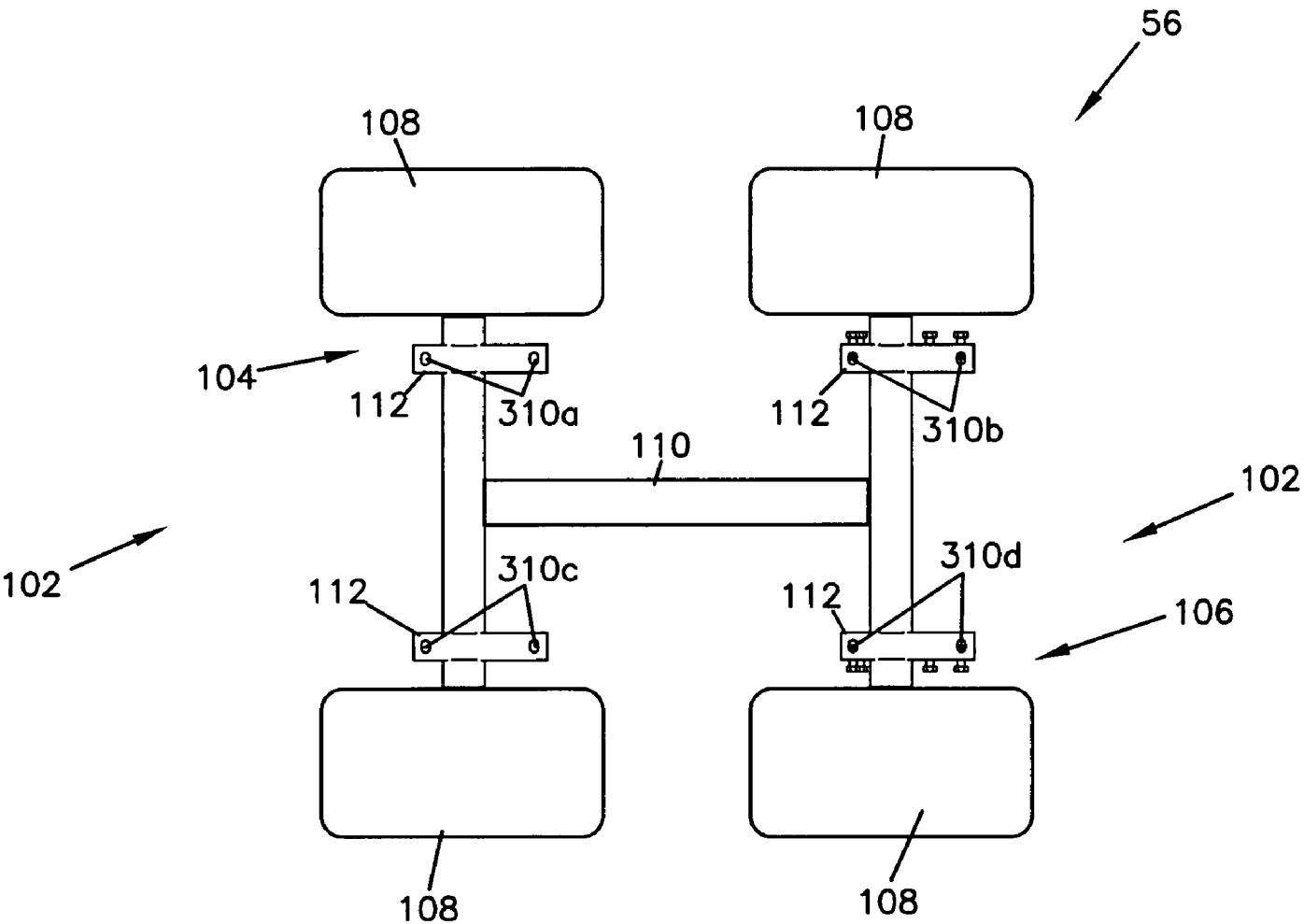
FIG. 17 is a top plan view of an alternative embodiment of a ground drive assembly that can be used in accordance with the principles disclosed.

Referring now to FIG. 17, in another embodiment, the drive arrangement 102 of the ground drive assembly 56 includes front and rear axle assemblies 104, 106. Wheels 108 are attached to the axle assemblies 104, 106. A chassis 110 interconnects the front and rear axle assemblies 104, 106. Similar to the previous embodiment, this ground drive assembly 56 also includes an arrangement or pattern of grouped bolt holes or mounting holes 310*a-d*. The grouped bolt holes 310*a-d* include bolt hole pairs. The pairs of bolt holes 310*a-d* are formed in flanges 112 mounted to the chassis 110. The pairs of bolt holes 310*a-d* are spaced apart and located to align with any one of the three sets of paired holes 250, 252 or 254 of the adapter frame 54. Accordingly, the ground drive assembly 56 having front and rear axle assemblies 104, 106 can be attached to the adapter frame 54 in any one of three positions, including the forward position, the centered position, and the rearward position.

As previously discussed, there are a number of implement configurations or arrangements that can be used for installing underground utilities. One feature of the present machine 50 is that the machine better accommodates each of a number of implement arrangements. For example, the present machine 50 stabilizes the weight associated with a number implement arrangements including: an implement mounted to only the front mounting arrangement 62 of the machine 50, an implement mounted to only the rear mounting arrangement 64 of the machine, or implements mounted to both of the front and rear mounting arrangement 62, 64.

Because of the adapter frame 54, the machine 50 can be adapted to counter balance and accommodate each of the different weight configurations associated with different implement arrangements. In particular, the main frame assembly 52, the adapter frame 54, and the ground drive assembly 56 of the present invention permits an operator to select the best position of the ground drive assembly 56, in relation to the upper assembly 52, for the specific implement configuration of the machine 50. The position of the ground drive assembly is selected based upon the excavation tools or implements that will be mounted to the machine 50.

For instance, referring back to FIGS. 5 and 6, the machine 50 is illustrated with the chain trencher 128 mounted at the rear of the machine. The ground drive assembly 56 is in a rearward position relative to the upper assembly 52 and the adapter frame 54 of the machine 50. In this configuration, the paired bolt holes 300*a-d* (FIG. 12) of the ground drive assembly 56 are aligned with the third set of paired holes 254*a-d* (FIG. 10) of the adapter frame 68.

In this first implement configuration, the ground drive assembly 56 is positioned rearward of the upper frame assembly 52, or in the alternative, the upper assembly 52 is positioned forward of the ground drive assembly 56. The rearward position of the ground drive assembly 56 maximizes the distance between the center of gravity of the upper assembly 52 and the center of gravity of the tracks 90, 92 of the ground drive assembly 56 to maximize the stability of the machine. This first implement configuration accommodates the significant weight of the chain trencher 128 located at the rear of the machine 50 without requiring significant loading of a weight kit (e.g., 36 in FIG. 2) at the front of the machine.

Figure 13:
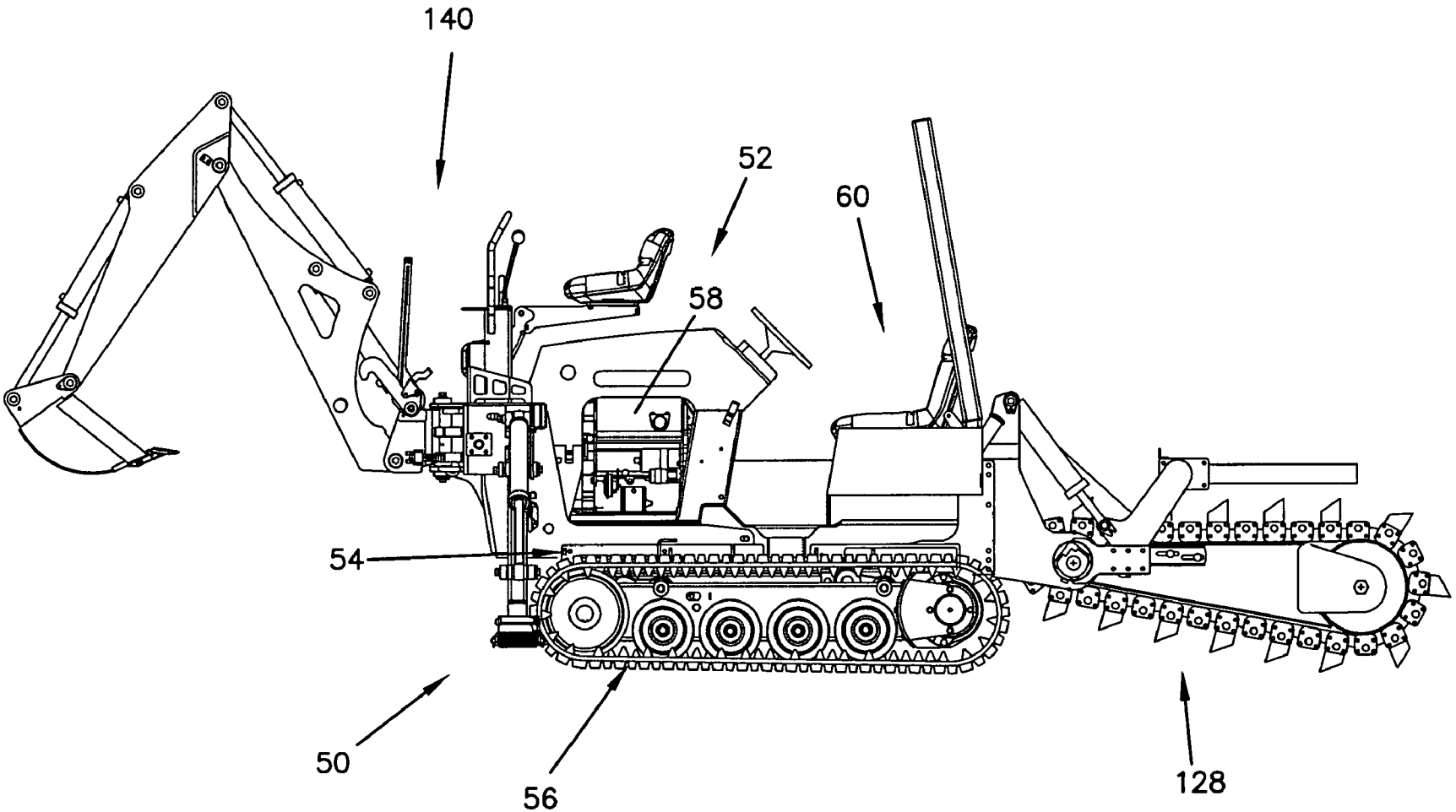
FIG. 13 is a side elevation view of the trencher machine of FIG. 5, shown with a chain trencher coupled to the rear of the machine, and a backhoe coupled to the front of the machine.
Figure 14:
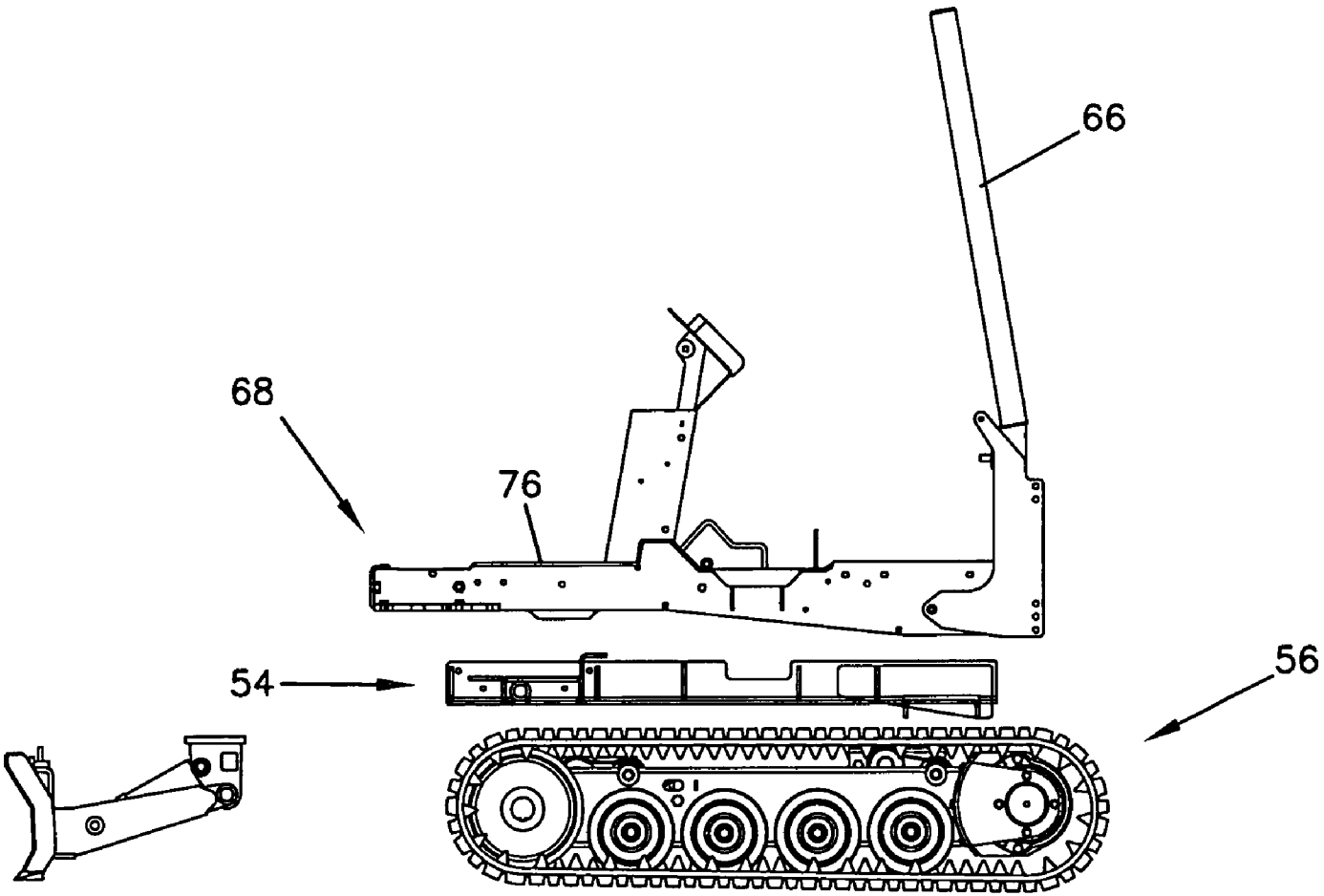
FIG. 14 is an exploded side view of the main frame assembly, the adapter frame, and the ground drive assembly of the machine of FIG. 13, the ground drive assembly being mounted in a central position relative to the main frame assembly.

Referring now to FIGS. 13 and 14, the machine 50 is illustrated with the chain trencher 128 mounted at the rear of the machine, and the backhoe 140 mounted at the front of the machine. The ground drive assembly 56 is in a middle or centered position relative to the upper assembly 52 and the adapter frame 54 of the machine 50. In this configuration, the paired bolt holes 300*a-d* (FIG. 12) of the ground drive assembly 56 are aligned with the second set of paired holes 252*a-d* (FIG. 10) of the adapter frame 68.

In this second implement configuration, the upper assembly 52 is centered in relation to the ground drive assembly 56. The centered position of the upper assembly 52 and the ground drive assembly 56 is appropriate in this configuration, as the weight of the backhoe 140 assists in offsetting the weight of the chain trencher 128.

Figure 15:
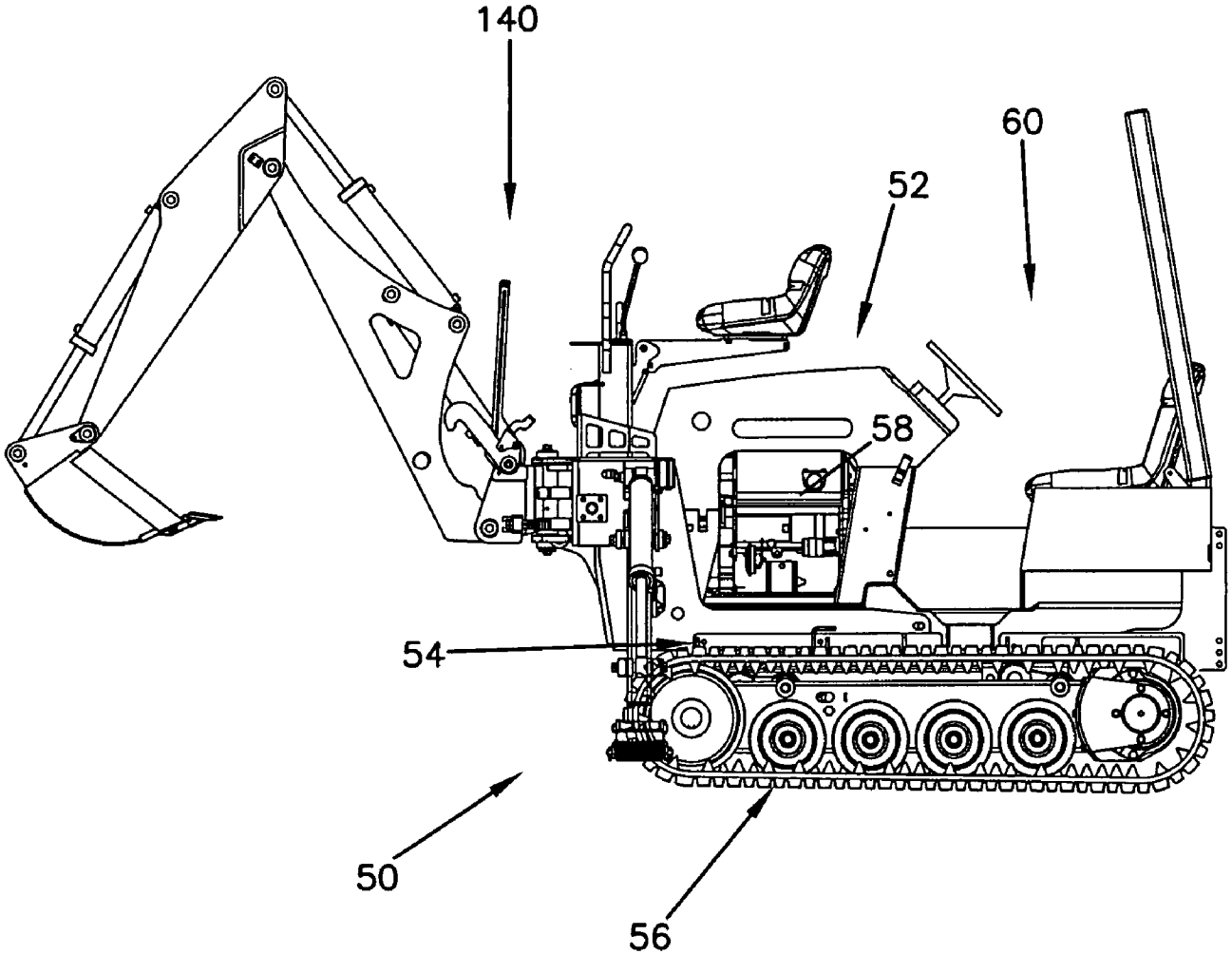
FIG. 15 is a side elevation view of the trencher machine of FIG. 5, shown with only a backhoe coupled to the front of the machine.
Figure 16:
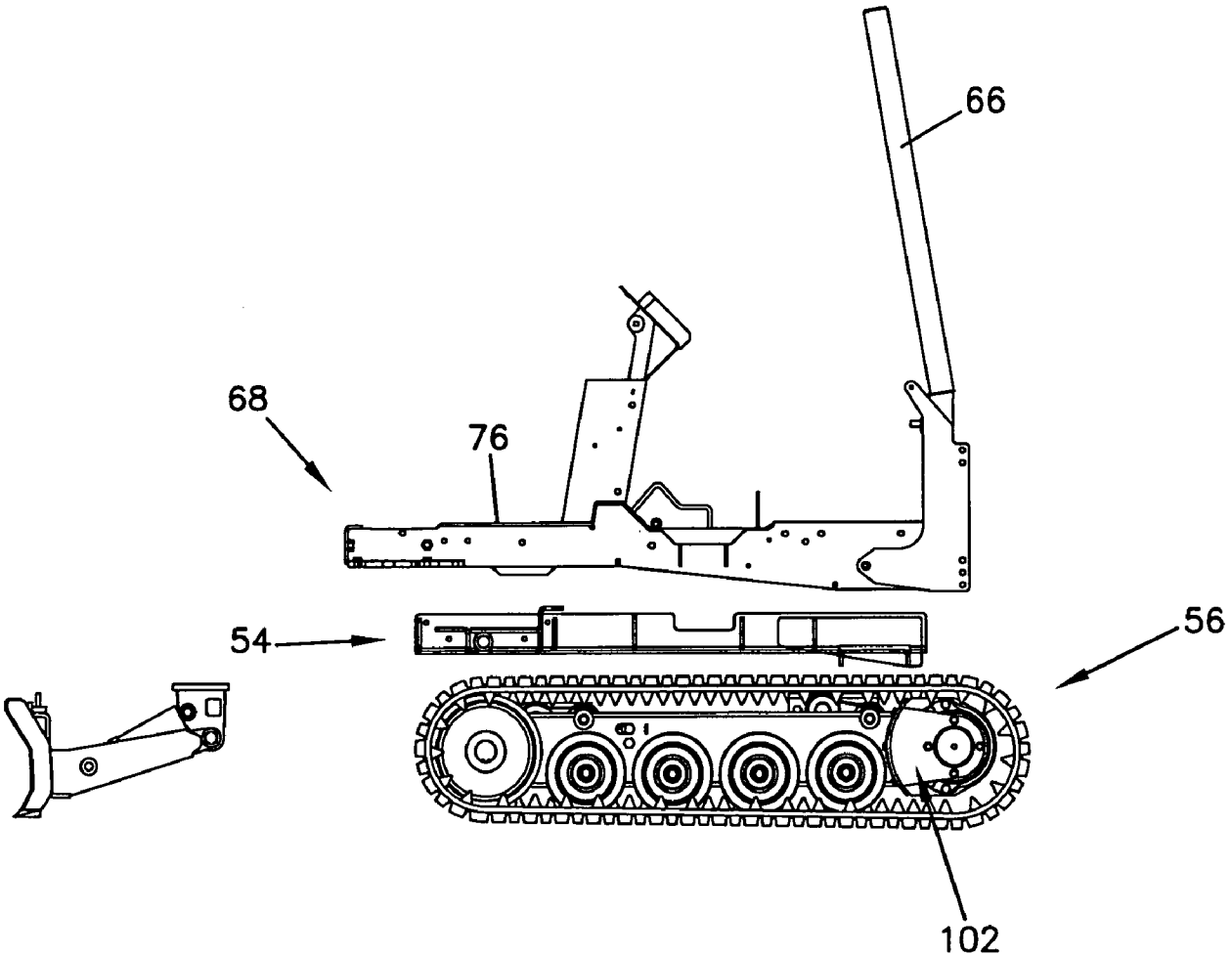
FIG. 16 is an exploded side view of the main frame assembly, the adapter frame, and the ground drive assembly of the machine of FIG. 15, the ground drive assembly being mounted in a forward position relative to the main frame assembly.

Referring now to FIGS. 15 and 16, the machine 50 is illustrated with only the backhoe 140. The backhoe 140 is mounted at the front of the machine 50. The ground drive assembly 56 is in a forward position relative to the upper assembly 52 and the adapter frame 54 of the machine 50. In this configuration, the paired bolt holes 300*a-d* (FIG. 12) of the ground drive assembly 56 are aligned with the first set of paired holes 250*a-d* (FIG. 10) of the adapter frame 68.

In this third implement configuration, the ground drive assembly 56 is positioned forward of the upper frame assembly 52, or in the alternative, the upper assembly 52 is positioned rearward of the ground drive assembly 56. The forward position of the ground drive assembly 56 maximizes the distance between the center of gravity of the upper assembly 52 and the center of gravity of the tracks 90, 92 of the ground drive assembly 56 to maximize the stability of the machine. This third implement configuration accommodates the significant weight of the backhoe 140 located at the front of the machine 50.

Figure 18:
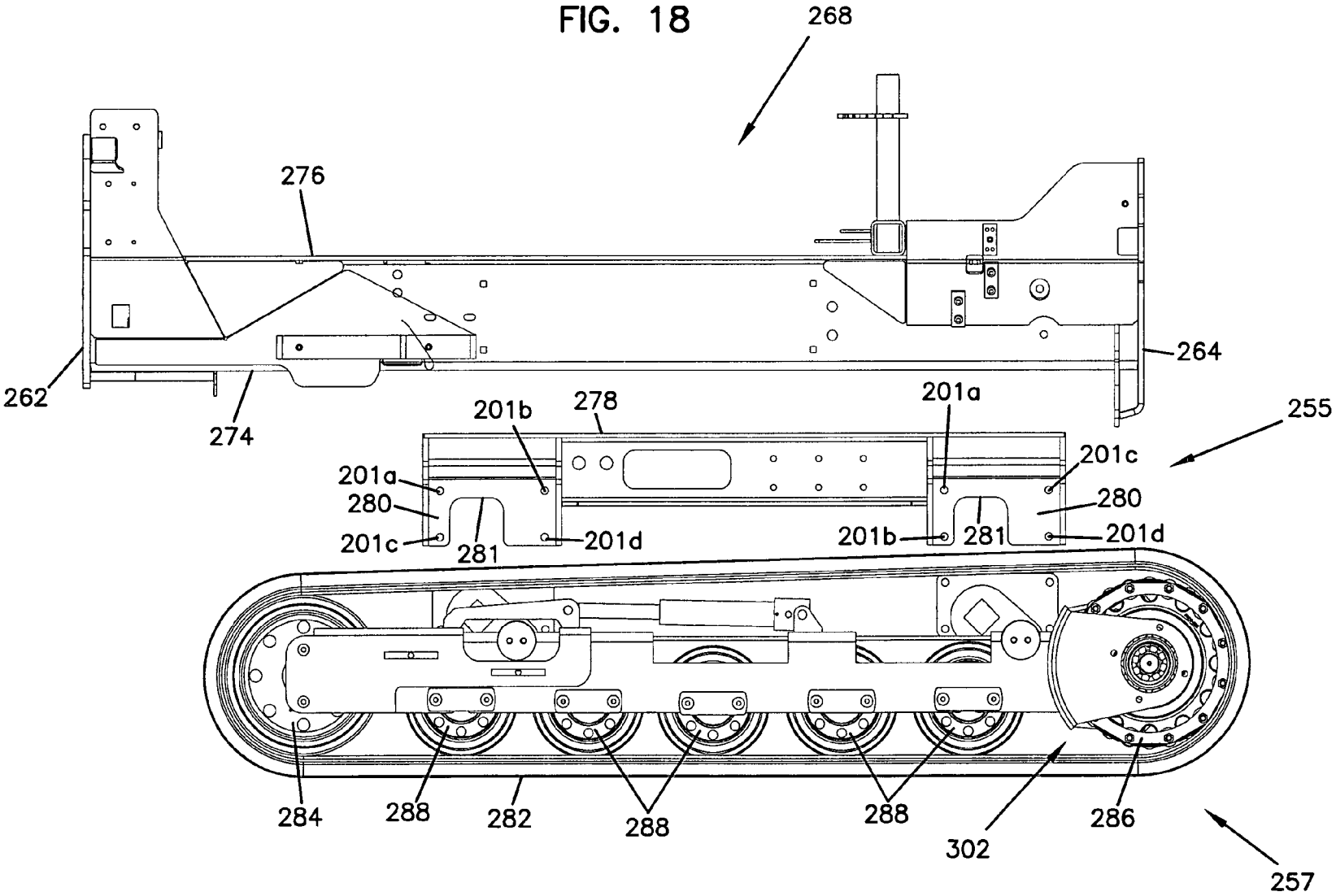
FIG. 18 is an exploded side view of another embodiment of a trencher machine, in accordance with the principles disclosed, showing alternative embodiments of only a main frame assembly, an adapter frame, and a ground drive assembly of the machine, the ground drive assembly is mounted in a central position relative to the main frame assembly.

FIG. 18 illustrates other embodiments of a main frame assembly 268 of an upper assembly, an adapter frame 255, and an undercarriage or ground drive assembly 257 that can be used in the making of an alternative mobile trencher machine, in accordance to the principles disclosed. The adapter frame 255 is coupled between, and to each of, the main frame assembly 268 of the upper assembly and the ground drive assembly 257.

Similar to the previous embodiment, the upper assembly (only partially shown by illustration of the main frame assembly 268) of the mobile machine includes an engine (e.g., 58 in FIG. 5) to power operation of the machine, and an operator station (e.g., 60 in FIG. 5). The engine mounts at a mounting surface 276 defined by the main frame assembly 268. The operator station includes a steering wheel and other controls (not shown), as previously described with respect to the first embodiment, for operating the machine. The main frame assembly 268 of the upper assembly includes a front mounting arrangement 262 and a rear mounting arrangement 264. Excavation implements or tools can be attached to one of or both of the front and rear mounting arrangements 262, 264.

Figure 19:
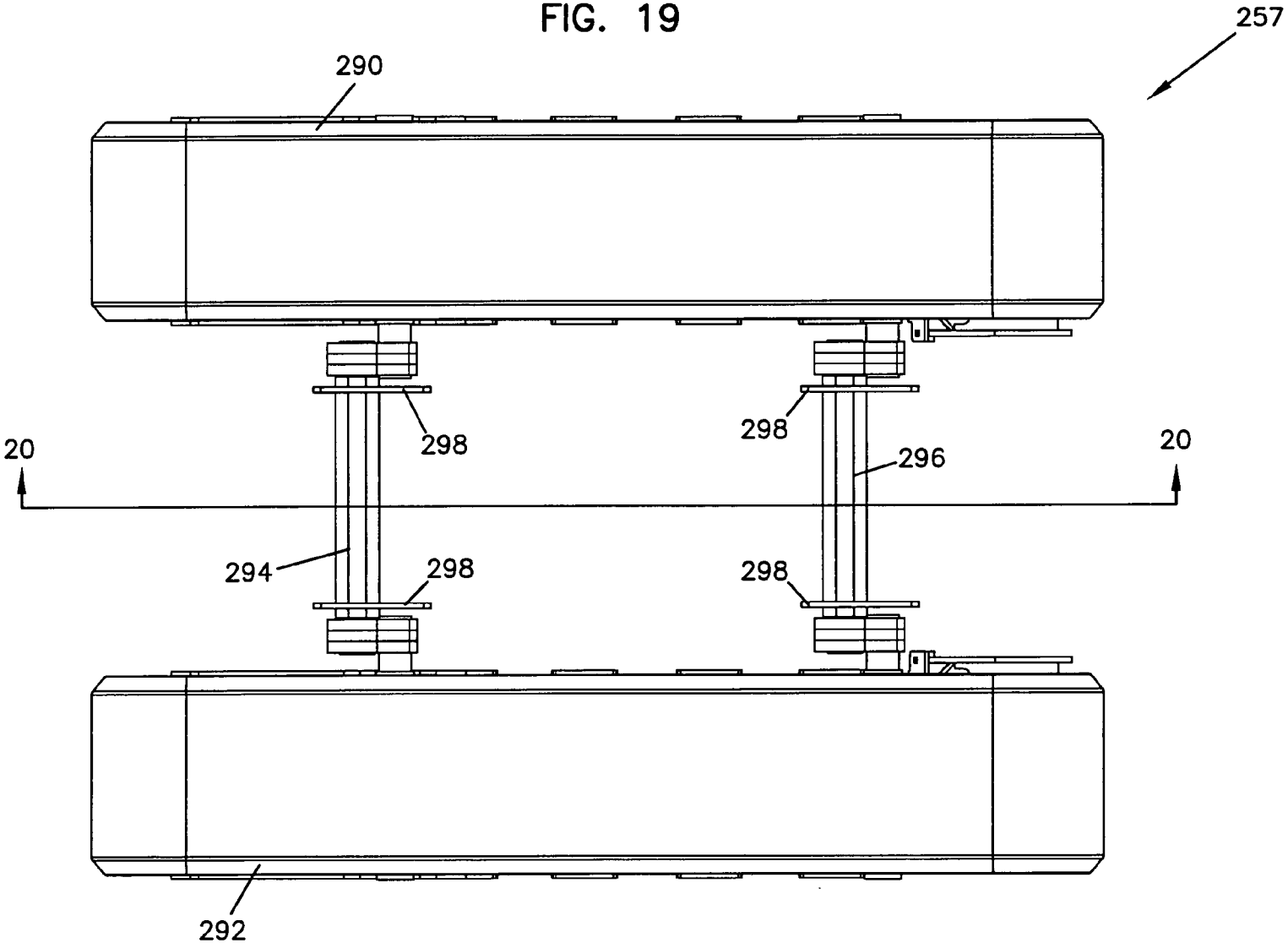
FIG. 19 is a top plan view of the ground drive assembly of FIG. 18.
Figure 20:
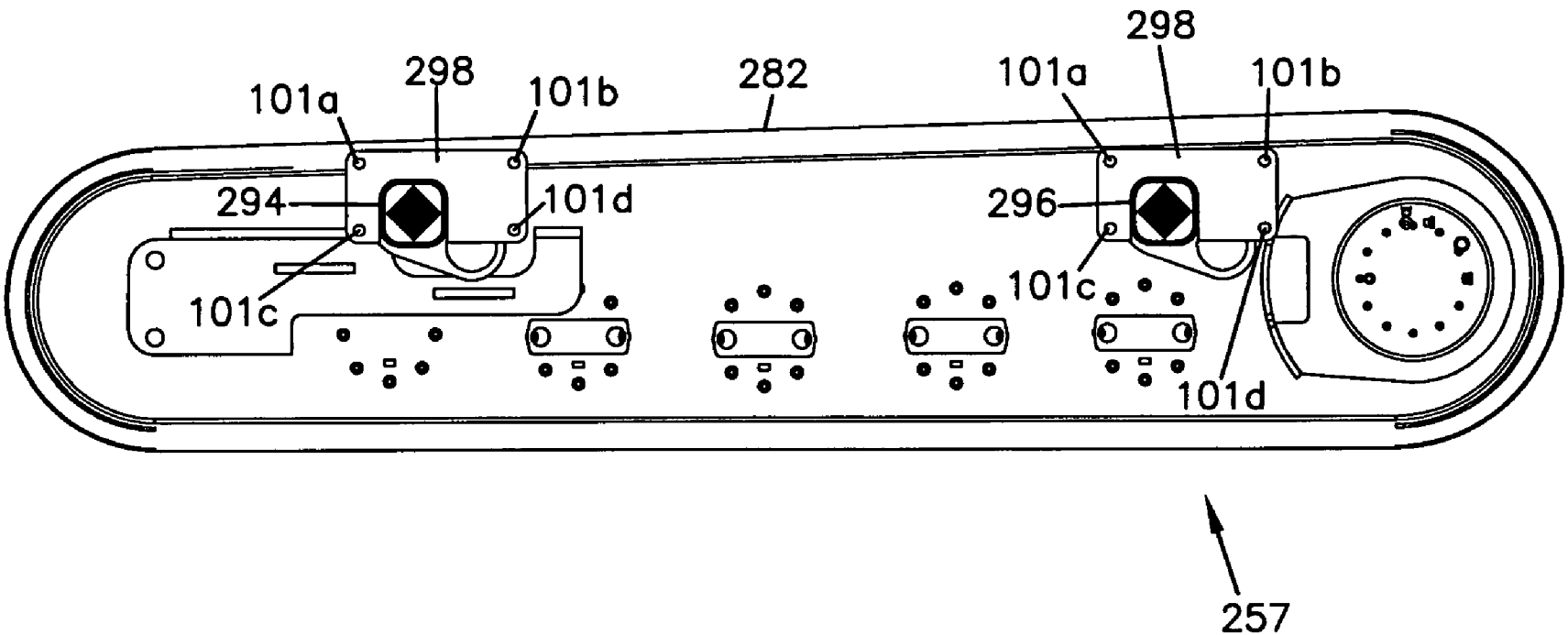
FIG. 20 is a cross-sectional view of the ground drive assembly of FIG. 19, taken along line 20-20.

The ground drive assembly 257 shown in FIG. 18 includes a drive arrangement 302 to provide travel of the machine and transport of the excavation implements. In one embodiment, the drive arrangement 302 includes right and left drive tracks 290, 292 (FIG. 19). Each of the right and left drive tracks 290, 292 includes a continuous track 282 wrapped around an idler roller 284 and a drive roller 286. Support rollers 288 are located between the idler roller 284 and the drive roller 286. Referring to FIG. 19, the right and left tracks 290, 292 of the ground drive assembly 257 are spaced apart by cross beams 294, 296. As shown in FIGS. 19 and 20, mounting flanges 298 are coupled to the cross beams 294, 296. Each of the mounting flanges 298 includes an arrangement or pattern of bolt holes or mounting holes 101*a-d* (FIG. 20) for mounting to the adapter frame 255. As previously discussed, other types of drive arrangements, such as front and rear axle assemblies, can be used in accordance with the principles disclosed.

Figure 21:
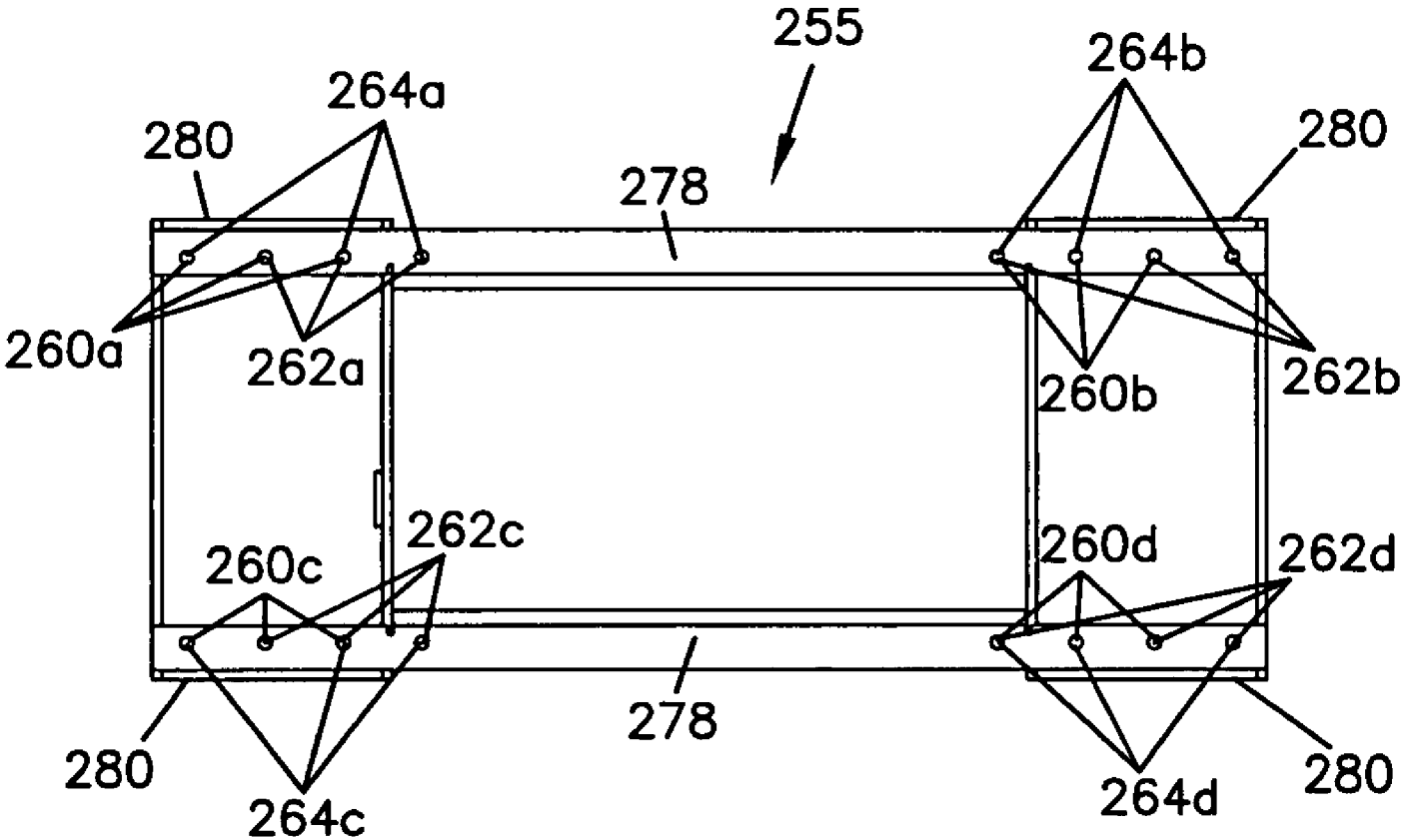
FIG. 21 is a top plan view of the adapter frame of FIG. 18.

Referring back to FIG. 18, the adapter frame 255 includes a top side 278 that couples to a bottom side 274 of the main frame assembly 268. Referring to FIGS. 18 and 21, the adapter frame 255 also include mounting plates 280 (e.g., four mounting plates 280, two located at each longitudinal side of the adapter frame 255) that couple to the mounting flanges 298 of the ground drive assembly 257 (FIG. 20).

Each of the mounting plates 280 of the adapter frame 255 includes an arrangement or pattern of bolt holes or mounting holes 201*a-d*. The pattern of mounting holes of the adapter frame 255 corresponds to the pattern of mounting holes 101*a-d* of the mounting flanges 298 of the ground drive assembly 257. The mounting plates 280 of the adapter frame 255 are arranged to fit within the mounting flanges 298 of the ground drive assembly 257. Notches 281 (FIG. 18) are formed in the mounting plates 280 for clearance of the cross beams 294, 296 of the ground drive assembly 257. When assembled, the pattern of mounting holes 201*a-d* of the adapter frame 255 align with the pattern of mounting holes 101*a-d* of the main frame assembly 268. The adapter frame 255 is coupled to the ground drive assembly 257 by utilizing bolts (not shown) that pass through the mating holes 101*a-d*, 201*a-d*. In this embodiment, the mating holes 101*a-d*, 201*a-d* provide a horizontal mounting arrangement. That is, the mounting structure (e.g., the mounting flanges 298 of the ground drive assembly 257 and the mounting plates 280 of the adapter frame 255) defining the mating holes 101*a-d*, 201*a-d* is generally vertical such that the bolts are received in a generally horizontal orientation, relative to ground.

Referring now to FIG. 21, the top side 278 of the adapter frame 255 also includes a first set of holes 260*a-d*, a second set of holes 262*a-d*, and a third set of holes 264*a-d*. Each of the sets, e.g., 260*a-d*, includes four groupings of holes 260*a*, 260*b*, 260*c*, 260*d*); each grouping in this embodiment includes three holes for a total of twelve holes in the set 260*a-d*. Each set of holes 260*a-d*, 262*a-d*, 264*a-d* is configured for mounting to the ground drive assembly 257.

Figure 22:
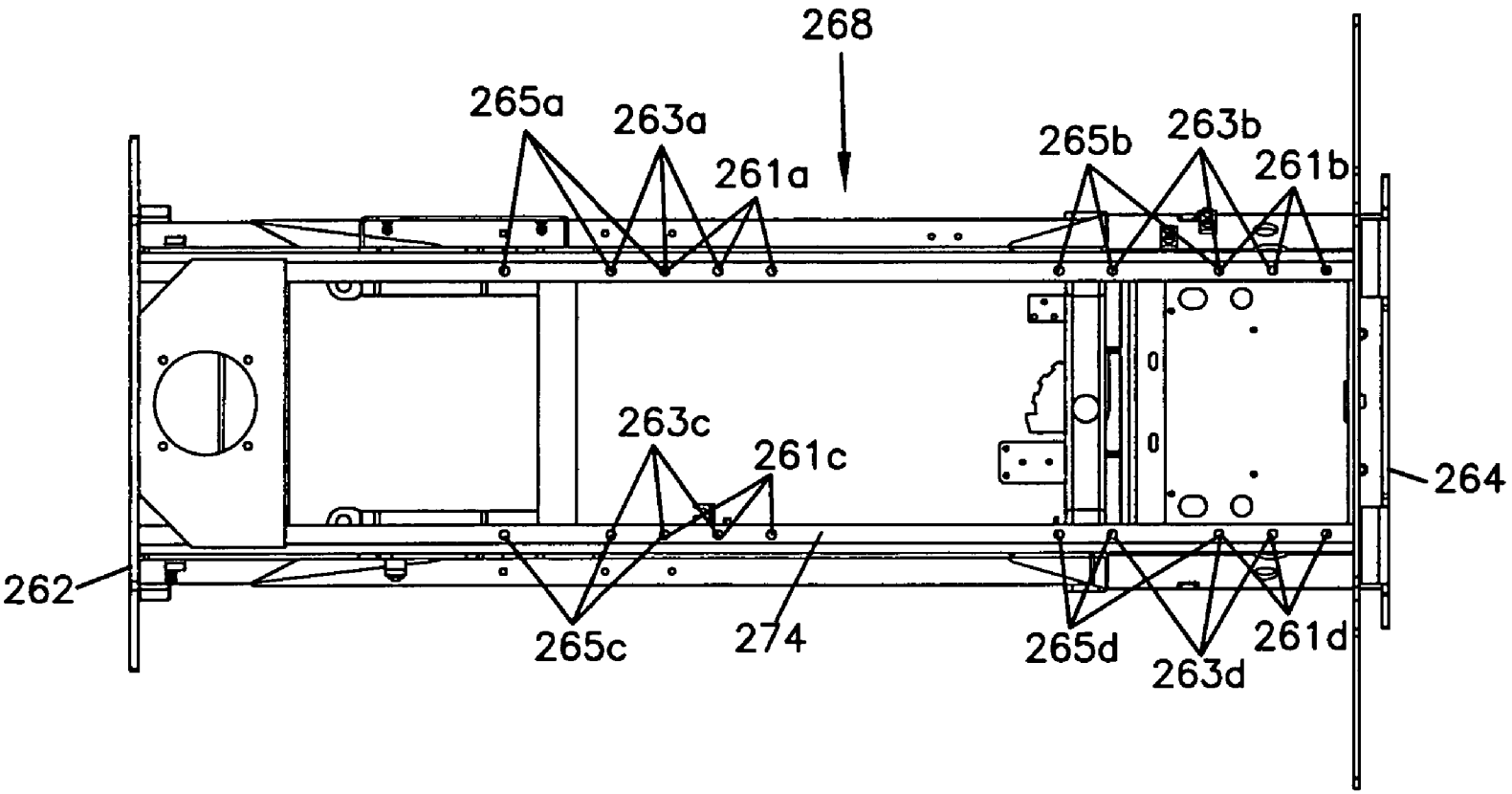
FIG. 22 is a bottom plan view of the main frame assembly of FIG. 18.

As shown in FIG. 22, the main frame assembly 268 of the machine also includes a corresponding first set of holes 261*a-d*, a second set of holes 263*a-d*, and a third set of holes 265*a-d*. Each of the sets, e.g., 261*a-d*, includes four groupings of holes 261*a*, 261*b*, 261*c*, 261*d*; each grouping in this embodiment including three holes for a total of twelve holes in the set 261*a-d*. The sets of grouped bolt holes 261, 263, 265 are formed in the bottom side 274 of the main frame assembly 268, and are spaced apart and located to align with any one of the three sets of grouped holes 260, 262 or 264 of the adapter frame 255. Accordingly, the ground drive assembly 257 can be attached to the adapter frame 255 in any one of three positions, including a forward position, a centered position, and a rearward position.

Similar to the previous embodiment, the adapter frame 255 of the present disclosure adapts the machine to counter balance and accommodate each of the different weight configurations associated with different implement arrangements. The ground drive assembly 257 and the adapter frame 255 may be positioned in a rearward position relative to the main frame assembly 268 (i.e., the upper assembly). For example, in the configured shown in FIG. 18, the second set of bolt holes 263*a-d* (FIG. 22) of the upper assembly (i.e. the main frame assembly 268) is aligned with the second set of holes 262*a-d* (FIG. 21) of the adapter frame 255. In this configuration, the ground drive assembly 257 and the adapter frame 255 are in the middle or centered position relative to the upper assembly. This can be used when, for example, the machine has excavation implements mounted to both the front and rear mounting arrangement 262, 264, as shown in FIG. 13.

In another configuration, the ground drive assembly 257 and the adapter frame 255 can be positioned rearward of the upper frame assembly to accommodate the weight configuration of an implement mounted only at the rear mounting arrangement 264 (see FIG. 5, for example). When the ground drive assembly 257 is in the rearward position, the first set of bolt holes 261*a-d* (FIG. 22) of the main frame assembly 268 is aligned with the first set of holes 260*a-d* of the adapter frame 255.

In another configuration, the ground drive assembly 257 and the adapter frame 255 can be positioned forward of the upper frame assembly to accommodate the weight configuration of an implement mounted only at the front mounting arrangement 262 (see FIG. 15, for example). When the ground drive assembly 257 is in the forward position, the third set of bolt holes 265*a-d* (FIG. 22) of the main frame assembly 268 is aligned with the third set of holes 264*a-d* of the adapter frame 255.

The present disclosure describes machines having an improved weight stabilization feature for use in a variety of excavation applications and with a variety of implement configurations. Various principles of the embodiments included in the present disclosure may be used in other applications. The above specification provides a complete description of the present invention. Since many embodiments of the invention can be made without departing from the spirit and scope of the invention, certain aspects of the invention reside in the claims hereinafter appended.

What is claimed is:

1. A machine, comprising:

a) an engine mounted to an engine frame assembly, the engine frame assembly including a front mounting arrangement and a rear mounting arrangement for attaching different excavation implements;

b) a drive frame assembly including a drive arrangement; and c) an adapter coupled to each of the engine frame assembly and the drive frame assembly, the adapter including:

i) a pattern of bolt holes to fixedly couple the adapter to one of the engine frame assembly and the drive frame assembly; and ii) three sets of bolt holes, the adapter being coupled to the other of the engine frame assembly and the drive frame assembly by way of a selected one of the sets of bolt holes;

d) wherein the drive frame assembly is selectively positionable in one of a number of positions relative to the engine frame assembly, the selected position corresponding to the selected one of the sets of bolt holes, and further corresponding to one or more selected excavation implements that are to be attached to one or both of the front and rear mounting arrangements, the number of positions including:

i) a forward position wherein the drive frame assembly is located generally forward of the engine frame assembly;

ii) a rearward position wherein the drive frame assembly is located generally rearward of the engine frame assembly; and iii) a central position located generally between the forward position and the rearward position.

2. The machine of claim 1, further including a first excavation implement attached to one of the front and rear mounting arrangements.

3. The machine of claim 2, further including a second excavation implement attached to the other of the front and rear mounting arrangements.

4. The machine of claim 3, wherein the excavation implements attached to the front and rear mounting arrangements each include a different one of a backhoe, a backfill blade, a plow, and a chain trencher.

5. The machine of claim 1, wherein the drive arrangement includes right and left drive tracks coupled to the drive frame assembly.

6. The machine of claim 1, wherein the drive arrangement includes forward and rearward axles having wheels.

7. The machine of claim 1, further including a vertical mounting arrangement provided between the engine frame assembly and the adapter.

8. The machine of claim 1, further including a horizontal mounting arrangement provided between the ground drive assembly and the adapter.

9. The machine of claim 1, wherein the adapter plate is constructed to permit the selectable positioning of the drive frame assembly relative to the engine frame assembly so that a user has options of utilizing a variety of different excavation implements mounted to the front mounting arrangement and mounted to the rear mounting arrangement, while stabilizing the weight of any one of the different excavation implements used.

10. The machine of claim 1, wherein the adapter plate is constructed to permit the selectable positioning of the drive frame assembly relative to the engine frame assembly to stabilize the weight of the machine when an excavation implement is attached to only the front mounting arrangement, and to also stabilize the weight of the machine when an excavation implement is attached to only the rear mounting arrangement, the excavation implements attached to the front and rear mounting arrangements being different excavation implements.

* * * * *